US009171530B2

(12) United States Patent
VanBuskirk

(10) Patent No.: US 9,171,530 B2
(45) Date of Patent: Oct. 27, 2015

(54) METHODS AND APPARATUS FOR CREATING MUSIC MELODIES USING VALIDATED CHARACTERS

(76) Inventor: Kel R. VanBuskirk, Chilliwack (CA)

( * ) Notice: Subject to any disclaimer, the term of this patent is extended or adjusted under 35 U.S.C. 154(b) by 536 days.

(21) Appl. No.: 13/454,824

(22) Filed: Apr. 24, 2012

(65) Prior Publication Data

US 2012/0269344 A1 Oct. 25, 2012

Related U.S. Application Data

(60) Provisional application No. 61/478,771, filed on Apr. 25, 2011.

(51) Int. Cl.

| | |
|---|---|
| ***G10H 1/36*** | (2006.01) |
| ***G10H 1/00*** | (2006.01) |
| ***H04K 1/00*** | (2006.01) |
| ***G10H 1/38*** | (2006.01) |

(52) U.S. Cl.

CPC ..... *G10H 1/0025* (2013.01); *G10H 1/38* (2013.01); *H04K 1/00* (2013.01); *G10H 2210/115* (2013.01); *G10H 2210/151* (2013.01); *G10H 2220/101* (2013.01)

(58) Field of Classification Search

USPC ..... 84/634

See application file for complete search history.

(56) References Cited

U.S. PATENT DOCUMENTS

| | | | | |
|---|---|---|---|---|
| 4,655,117 | A * | 4/1987 | Roose | 84/423 B |
| 6,444,888 | B1 * | 9/2002 | VanDruff | 84/609 |
| 6,740,802 | B1 * | 5/2004 | Browne, Jr. | 84/609 |
| 8,487,173 | B2 * | 7/2013 | Emmerson | 84/601 |

* cited by examiner

*Primary Examiner* — Christopher Uhlir

(74) *Attorney, Agent, or Firm* — K&L Gates LLP

(57) ABSTRACT

A method of operating a music creation system is disclosed. The method includes receiving an input of characters, executing an algorithm to transform the characters into a string of musical notes, displaying the string of musical notes in a human readable format through the at least one output device, and acoustically outputting the string of musical notes.

23 Claims, 22 Drawing Sheets

METHODS AND APPARATUS FOR CREATING MUSIC MELODIES USING VALIDATED CHARACTERS

PRIORITY CLAIM

This application claims priority to and the benefit of U.S. Provisional Patent Application Ser. No. 61/478,771, filed Apr. 25, 2011, entitled "Methods and Apparatus for Creating Music Melodies", the entire contents of which are hereby incorporated by reference and relied upon.

TECHNICAL FIELD

The present disclosure relates in general to music software, and, in particular, to methods and apparatus for creating music melodies.

BACKGROUND

Musicians generally have to create or write melodies to create a song. To create a melody, musicians need to select a group of music notes or chords and organize them into an arrangement that appeals to the musician or listener. For a writer of music, the difficulty in writing a song lies in the selection of notes and chords and the corresponding arrangement of said notes and chords into a musically appealing arrangement to create a melody that serves as a basis for the song.

Music software presently enables a user to input individual notes and chords, generally in the form of a base melody, into music software. The software generally enables the user to modify the notes and chords and provides playback of the input and modification. The base melody can be manipulated by the software to obtain a manipulated melody most suitable to the user's needs. While such software is valuable for teaching music and writing music, existing music software does not help a musician create an initial melody, or string of music notes and chords, that is a necessary first step in writing a song.

SUMMARY

The presently disclosed method and apparatus solves this problem by applying music-related algorithms to inputted words or strings of characters, which are unrelated to musical notes or chords, to produce music melodies. The example method and apparatus described herein uses mathematical probabilities combined with ciphering algorithms to convert the inputted words or strings of characters into musical melodies. The example method and apparatus include a user interface that enables a user to input text or strings of characters and select a type of recipe that corresponds to a unique algorithm for generating a melody. The user interface displays the melody in the form of human readable musical notes. The user interface also enables a user to modify the generated melody to achieve a desired melody, song, etc.

The example method and apparatus described herein may be implemented in a stand-alone software program, a software module integrated with commercially available musical creation and editing software, and/or an application operating on a mobile device such as, for example, a smartphone or a tablet computer. The example method and apparatus described herein may be integrated with social media applications to enable individuals to collaborate on songs or melodies or to generate melodies between individuals. The example method and apparatus described herein may also be used in cryptology applications to protect transferred data using ciphering algorithms based on musical melodies.

It is accordingly an advantage of the present disclosure to provide a method and apparatus to create musical melodies based on text or characters.

It is another advantage of the present disclosure to enable a user to modify musical properties of musical melodies created from text or characters.

It is a further advantage of the present disclosure to enable users to collaborate on the creation of musical melodies based on text or characters.

It is yet another advantage of the present disclosure to encrypt messages, data or files using the method and apparatus to create musical notes or chords based on text or characters.

Additional features and advantages of the system and methods are described herein and will be apparent from the following Detailed Description and figures.

DETAILED DESCRIPTION

The example method and apparatus are described herein as a device employing a non-web based computer program. One of skill in the art can appreciate that the example method and apparatus are not limited to this implementation. In other embodiments, the example method and apparatus could be implemented as a software module integrated with additional music editing software such as, for example, Sibelius®, Propellerhead Software™, Finale®, Ableton®, Garage Band®, Pro Tools®, or Cubase®. Additionally, the example method and apparatus could be implemented as a mobile application or social media plug-in operable on a smartphone or tablet computer.

Figure 1:
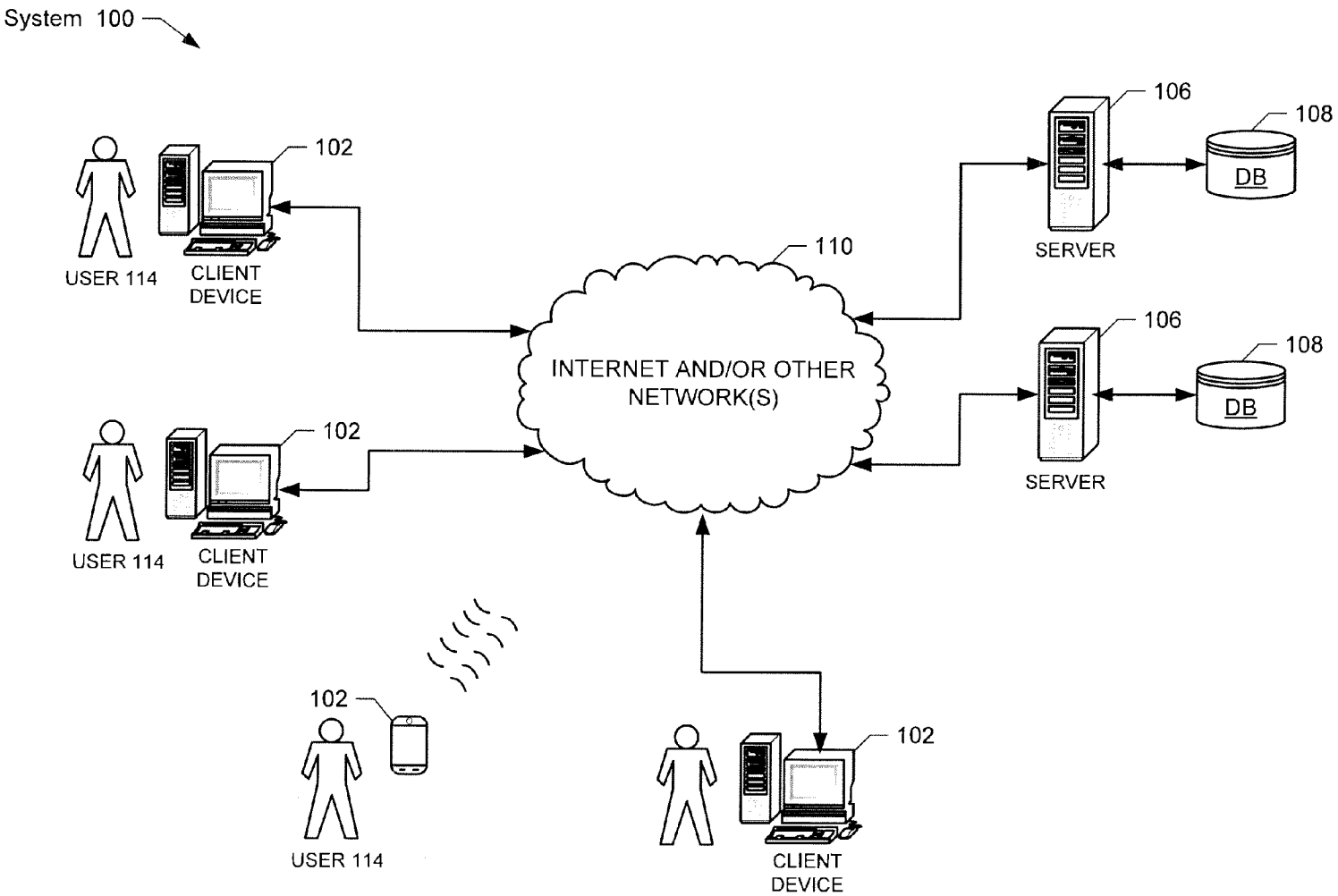
FIG. 1 is a high level block diagram of an example communications system.

A high level block diagram of an exemplary network communications system 100 is illustrated in FIG. 1. The illustrated system 100 includes one or more client devices 102, one or more web servers 106, and one or more databases 108. Each of these devices 102 may communicate with each other via a connection to one or more communications channels 110 such as the Internet or some other wired and/or wireless data network, including, but not limited to, any suitable wide area network or local area network. As stated above, it will be appreciated that any of the devices described herein may be directly connected to each other instead of over a network.

For each of the devices 102 employed in the network communications system 100, web server 106 stores a plurality of files, programs, and/or web pages in one or more databases 108 for use by client devices 102 as described in detail below. Database 108 may be connected directly to the web server 106 and/or via one or more network connections. Database 108 stores data as described in detail below.

One web server 106 may interact with a large number of client devices 102. Accordingly, each server 106 is typically a computer with a large storage and processing capacity, one or more fast microprocessors, and/or one or more high speed network connections. Conversely, relative to a typical server 106, each client device 102 typically includes less storage capacity, a single microprocessor, and a single network connection.

Figure 2:
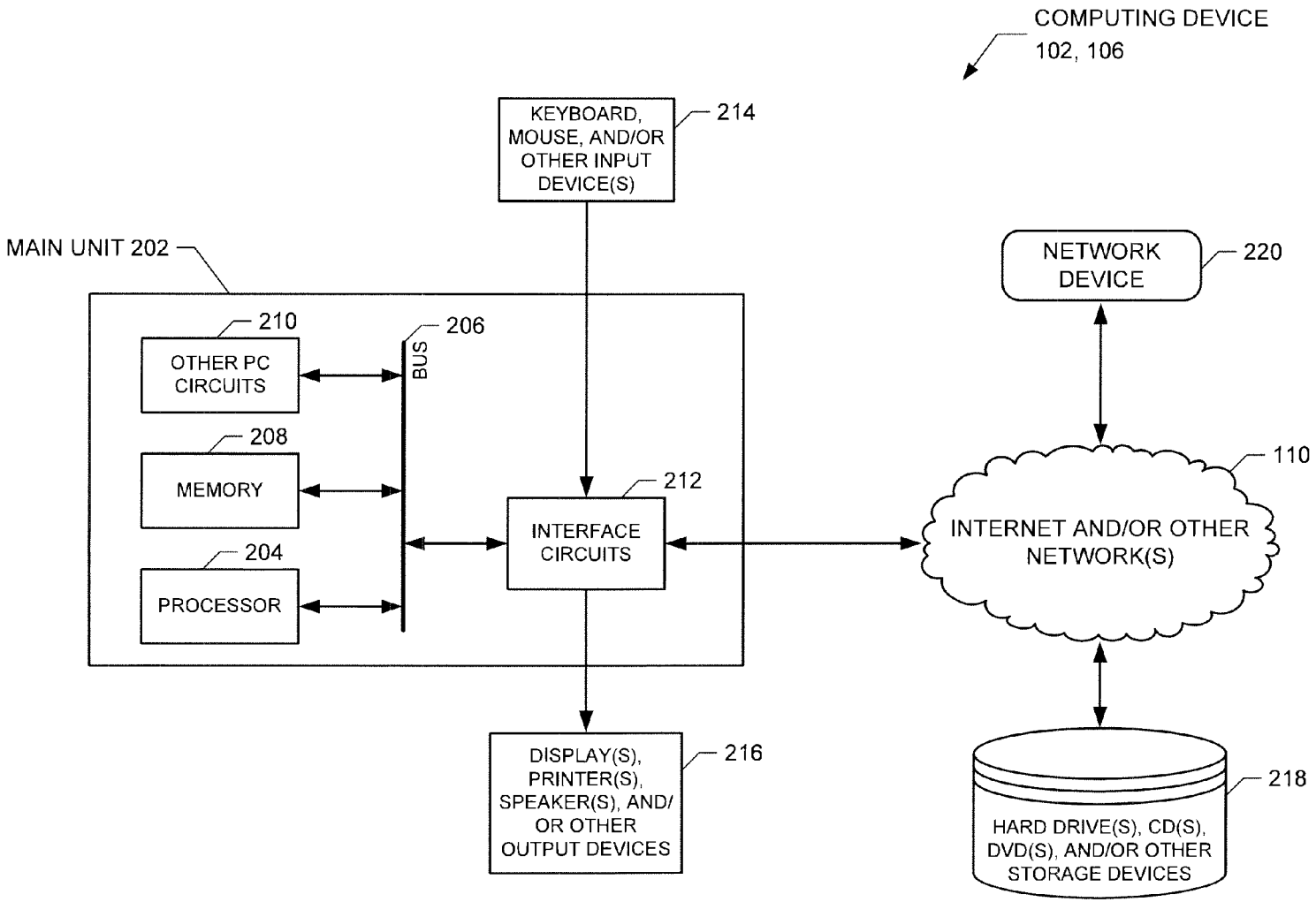
FIG. 2 is a more detailed block diagram showing an example of a computing device.

A more detailed block diagram of the electrical systems of a computing device (e.g., client device 102 and/or server 106) is illustrated in FIG. 2. Although the electrical systems of a client device 102 and a typical server 106 may be similar, the structural differences between the two types of devices are well known.

Client device 102 may include a personal computer ("PC"), desktop computer, a tablet computer, a music system such as a stereo, an electrically powered musical instrument such as an electronic keyboard, a personal digital assistant ("PDA"), an Internet appliance, a cellular telephone, a smartphone, a digital music player, or any other suitable communication device. Client device 102 may also be a stand alone device capable of docking with one of the above communication devices such as a person computer or electrically powered musical instrument, such that melodies produced from the stand alone device can be uploaded, manipulated and acoustically outputted by the suitable communication device.

Client device 102 includes a main unit 202, which preferably includes one or more processors 204 electrically coupled by an address/data bus 206 to one or more memory devices 208, other computer circuitry 210, and one or more interface circuits 212. Processor 204 may be any suitable processor. Memory 208 preferably includes volatile memory and non-volatile memory. Preferably, memory 208 stores a software program that executes a process such as the example described below and illustrated in the flowcharts of FIGS. 5 to 9 to produce music melodies. This program may be executed by processor 204 in any suitable manner. Memory 208 may also store digital data indicative of documents, files, programs, web pages, etc. retrieved from server 106 and/or loaded via an input device 214, as well as output data from processor 204 after executing the software program.

Interface circuit 212 may be implemented using any suitable interface standard, such as an Ethernet interface and/or a Universal Serial Bus ("USB") interface. One or more input devices 214 may be connected to interface circuit 212 for entering data and commands into main unit 202. For example, input device 214 may be a keyboard, mouse, touch screen, track pad, track ball, isopoint, and/or a voice recognition system.

One or more displays, printers, speakers, and/or other output devices 216 may also be connected to main unit 202 via interface circuit 212. Display 216 may be a cathode ray tube (CRTs), liquid crystal displays ("LCDs"), or any other type of display. Display 216 generates visual displays of data generated during operation of client device 102. For example, display 216 may be used to display web pages or application data received from server 106 or output data received from processor 204. The visual displays (e.g., user interfaces) may include prompts for user input, calculated values, data, etc.

One or more storage devices 218 may also be connected to main unit 202 via interface circuit 212. For example, a hard drive, CD drive, DVD drive, and/or other storage devices may be connected to main unit 202. Storage devices 218 may store any type of data used by client device 102.

Client device 102 may also exchange data with other network devices 220 via a connection to network 110. The network connection may be any type of network connection, such as an Ethernet connection, digital subscriber line ("DSL"), telephone line, coaxial cable, etc. Alternatively, the network connection may be wireless. Users 114 of the system 100 may be required to register with the server 106. In such an instance, each user 114 may choose a user identifier (e.g., e-mail address) and a password which may be required for the activation of services. The user identifier and password may be passed across the network 110 using encryption built into the user's browser. Alternatively, the user identifier and/or password may be assigned by the server 106.

Electronic Keyboard Embodiment

Figure 3:
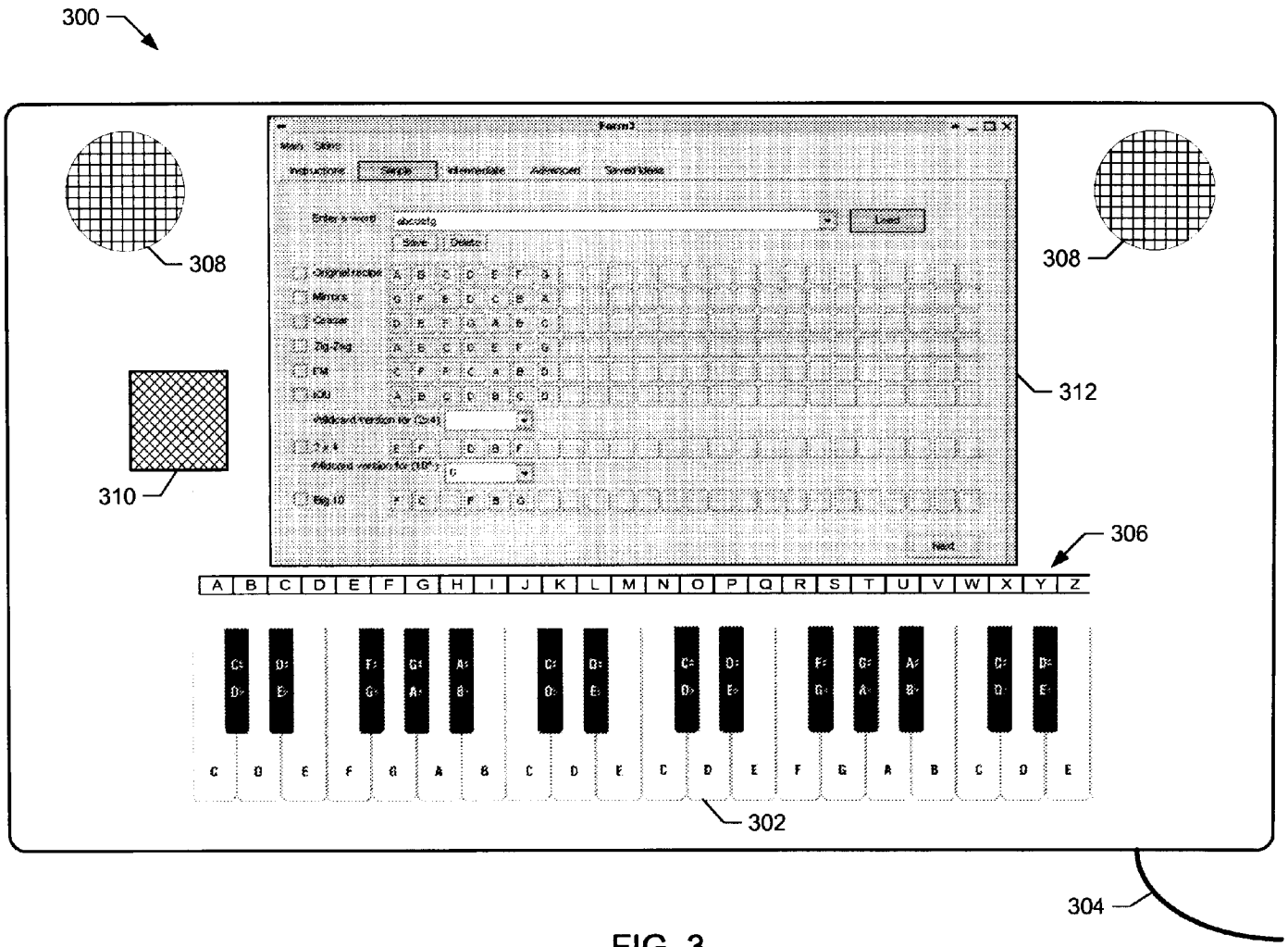
FIG. 3 is a top view of a keyboard with a touchscreen interface that incorporates an embodiment of the software program of the present invention.

FIG. 3 illustrates an example of device 102 in the form of an electronic keyboard 300 with a screen 312 for interacting with the software program that produces music melodies. Keyboard 300 includes piano keys 302, power cord 304, program buttons 306, speakers 308, microphone 310 and display screen 312. Power cord 304 includes a plug that connects to an electrical outlet that powers keyboard 300. Alternatively, keyboard 300 can be powered by any suitable battery.

Program buttons 306 can include any combination of functions necessary to operate the program displayed on screen 312 and which will be described in detail below. Program buttons 306 can be, for example, membrane switches, mechanical switches, or any other type suitable switch or button.

Speakers 308 are configured to sonically and/or acoustically output musical notes produced by pressing piano keys 302. Speakers 308 are also configured to acoustically output melodies produced by the software program displayed on screen 312. Speakers 308 will acoustically output said melodies when instructed by a user.

Microphone 310 is configured to receive voice input from the user in the form of, for example, verbal commands readable by a voice recognition system in keyboard 300, or verbal notes or lyrics readable and recordable by memory 208.

Besides being a display screen, screen 312 can also be a touchscreen, as illustrated in FIG. 3. As a touchscreen, the majority of user input will be delivered by direct contact with touchscreen 312. In this case, many of the functions of program buttons 306 will be incorporated into user input locations directly on touchscreen 312. Buttons 306 however can retain certain functions such as, for example, providing the letters of the alphabet, as illustrated in FIG. 3, so that the user can input a word or character string for the software program to process as will be described below.

As further illustrated in FIG. 3, screen 312 can be integrated into keyboard 300 such that screen 312, and the associated software program, is a permanent component of keyboard 300. Screen 312 can be used exclusively to display the software program interface, or can be used to display the software program along with other applications common to an electronic keyboard, such as MIDI (Musical Instrument Digital Interface) compatible software. MIDI software allows electronic keyboards to communicate, control, and synchronize with other MIDI-compatible electronic musical instruments. MIDI also allows computers, synthesizers, MIDI controllers, sound cards, samplers and drum machines to control one another, and to exchange system data.

Stand Alone Device Embodiment

Figure 4:
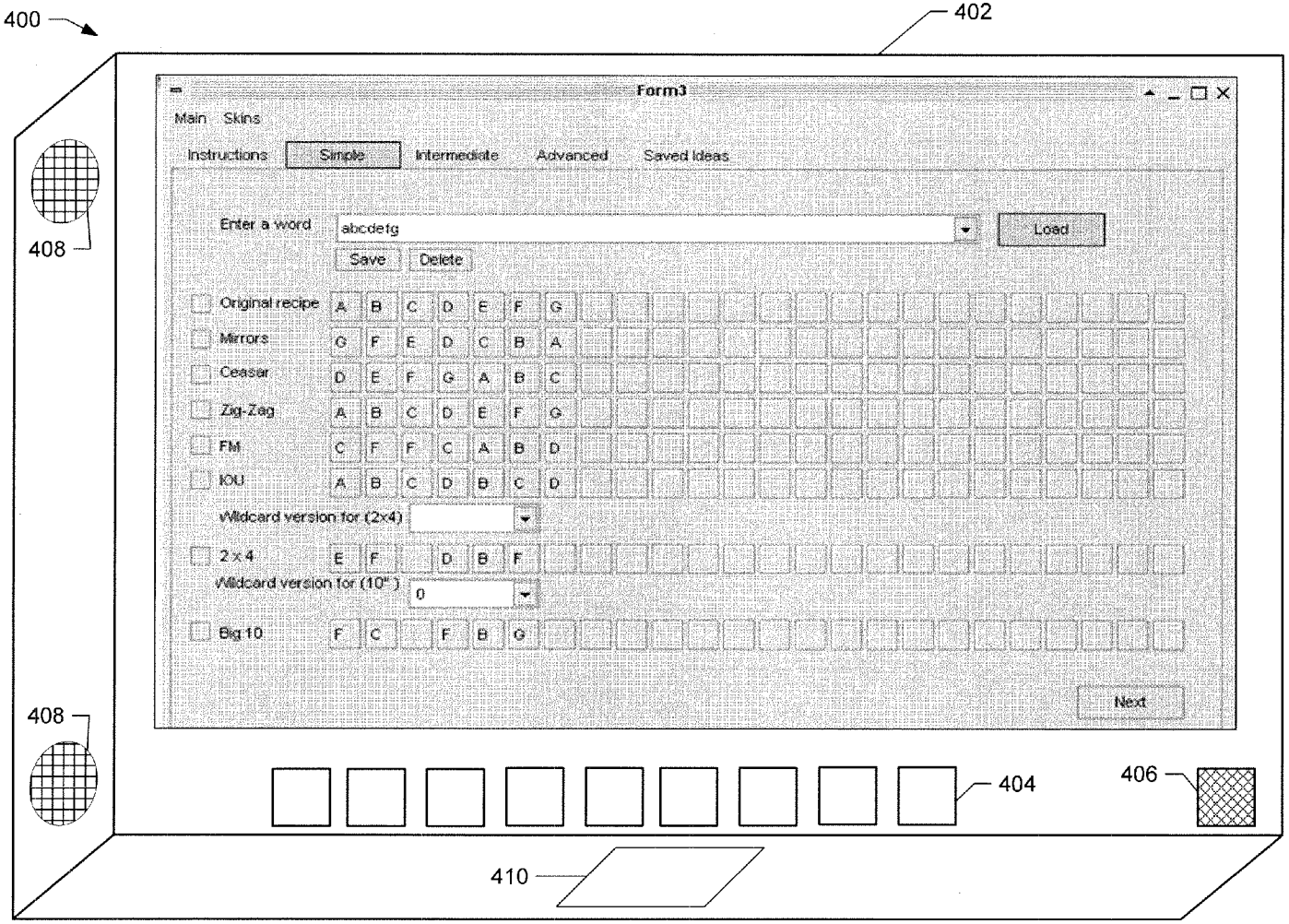
FIG. 4 is a perspective view of a stand alone device with touchscreen interface that incorporates an embodiment of the software program of the present invention.

Screen 312 can alternatively be separable from keyboard 300 such that screen 312 is a stand alone device 400, illustrated in FIG. 4, capable of executing the software program and acoustically outputting the melodies produced by the software program. In this embodiment, the stand alone device includes screen display 402, program buttons 404, microphone 406, speakers 408 and battery/electrical cord (not pictured) similar to that which was discussed above with regard to keyboard 300. Like keyboard 300, stand alone device can 400 have screen 402 serve as a display or as a touchscreen with program buttons 404 configured to execute the functions necessary to operate the program displayed on the screen/touchscreen 402.

Stand alone device 400 can also include an adapter 410 configured to dock device 400 into a docking station, such as a docking station on keyboard 300, personal computer, or any other suitable communication device as discussed above.

Creating Musical Melodies

A flowchart of an example process 500 for creating music melodies using a software program is illustrated in FIGS. 5 to 9. Preferably, the process 500 is embodied in one or more software programs which is stored in one or more memories and executed by one or more processors. Although the process 500 is described with reference to the flowchart illustrated in FIGS. 5 to 9, it will be appreciated that many other methods of performing the acts associated with process 500 may be used. For example, the order of many of the steps may be changed, and many of the steps described may be optional. Moreover, process 500 may include an introductory page, illustrated by FIG. 10. The introductory page may include some introductory instructions or tutorial information that teaches the user how to use the software program.

Figure 11:
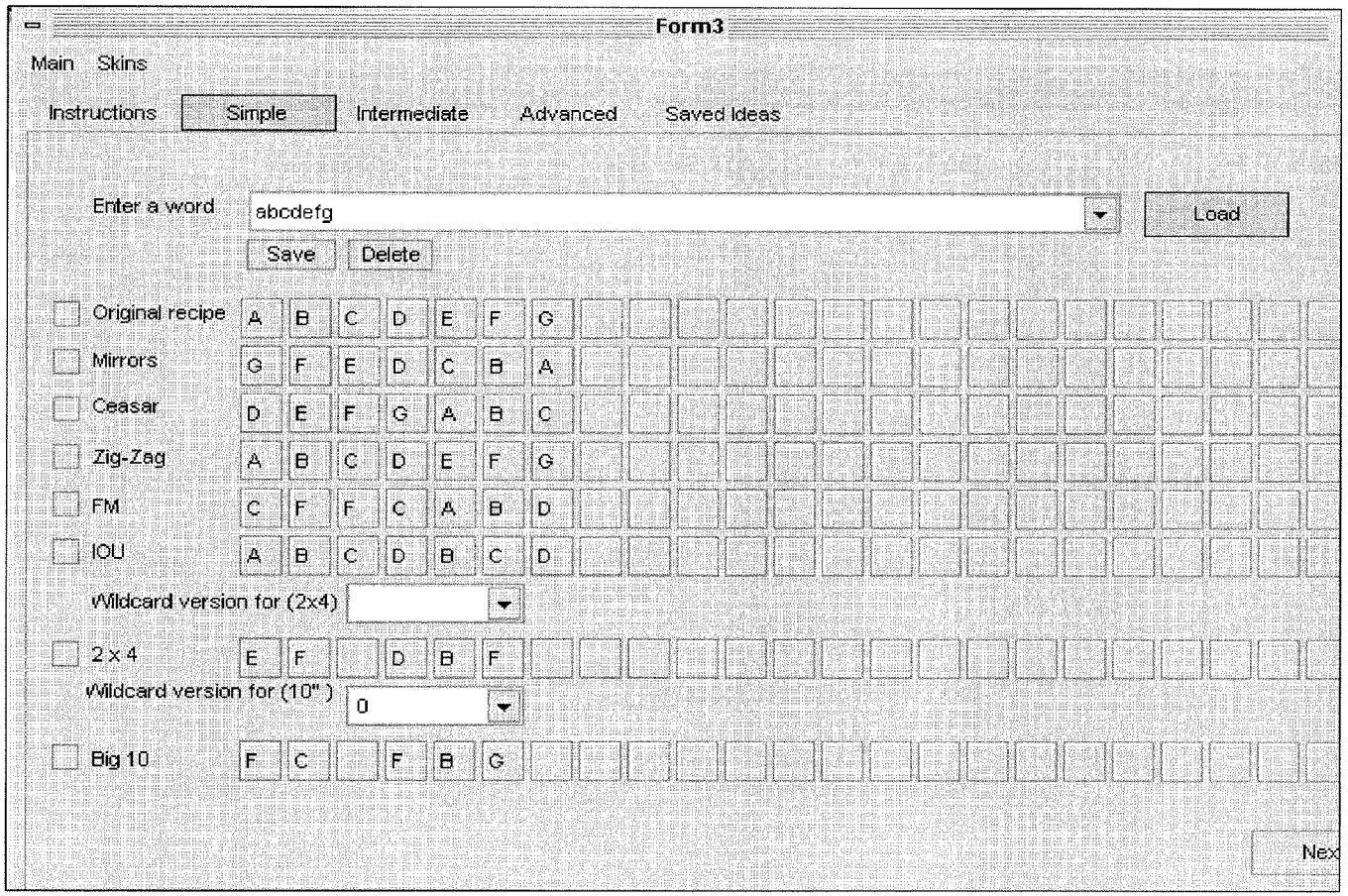
FIG. 11 shows a first user input page from an embodiment of the software program associated with FIGS. 5 and 6 that creates music melodies.

In general, the process 500 causes a computing device 102 to execute a program to create music melodies. The process 500 generally begins when the software program displays to the user, via display 312, a user input location and a plurality of recipe options on a first screen, or "Simple" screen (block 502). The "Simple" screen is shown for example in FIG. 11. As shown in FIG. 11, the "Simple" screen provides a user input location labeled "Enter a word" where the user can enter a single word, multiple words, or any string of characters that includes a combination of spaces and English letters. In other embodiments, the process may use letters of different languages such as, for example, the letters from the Mandarin Chinese alphabet. If the user desires to enter a previously inputted character string, the user can re-input the string or choose the string from a drop down box associated with the user display location.

After receiving the character string input and corresponding user input to "Load" the character string (block 504), device 102 executes a routine that determines whether each inputted character meets the present requirement for "character" (block 506). For example, in FIG. 11, a proper entry for "character" must include a combination of spaces and English letters. The proper entry for "character" however is not a permanent definition and can be manipulated as necessary.

Referring back to FIG. 5, if each character does meet the present requirement for "character," then device 102 executes specific algorithms for the entire inputted character string, as will be described below with relation to FIG. 6 and FIG. 11.

If each inputted character does not meet the present requirement for "character," then device 102 executes a subroutine that determines whether every inputted character fails to meet the present requirement for "character" (block 508). If every character fails to meet the present requirement for "character," then device 102 removes all the characters inputted into the user display location (block 510). The user can either be prompted to once again "Enter a word" or the user will recognize that the initially inputted string has been deleted and can attempt to enter another word, or string of characters and spaces. Device 102 will repeat the loop of blocks 504 to 510 until at least one user inputted character string meets the present requirement for "character."

If each inputted character does not meet the present requirement for "character" but not every character fails to meet the present requirement for "character" (i.e., user inputs at least one "character"), then device 102 removes the faulty inputted characters (block 512) and executes the specific algorithms for only the properly inputted characters, described below with relation to FIG. 6 and FIG. 11.

For example, if device 102 requires that every "character" be either a space or an English letter, the string "abc defg" will not be revised prior to algorithm execution, the string "ab3de5g" will be revised to "abdeg" prior to algorithm execution, and the string "43%45##" will be completely removed and the user will either be prompted to once again "Enter a word" or the user will recognize that the initially inputted string has been deleted and can attempt to enter another word, or string of characters and spaces.

Figure 6:
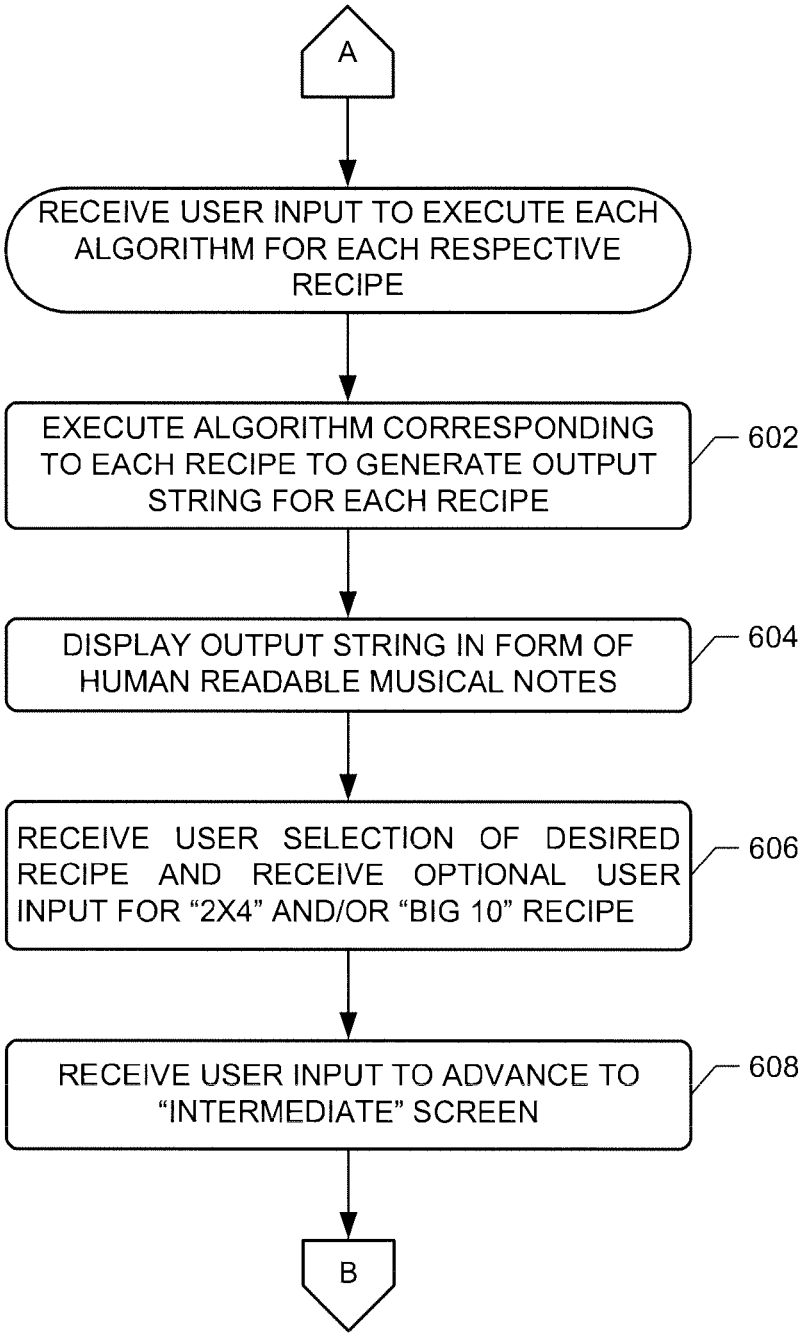

Referring now to FIG. 6, after the user has input an appropriate character string, device 102 executes algorithms specific to each of the recipes listed on the "Simple" screen shown, for example, in FIG. 11 (block 602). Recipes include, for example, an "Original" recipe, a "Mirrors" recipe, a "Ceasar-Salad" recipe, a "Zig-Zag" recipe, an "FM" recipe, an "IOU" recipe, a "2×4" recipe, and a "Big 10" recipe. Each recipe has an algorithm unique to that recipe that mathematically manipulates the inputted character string and outputs the character string in the form of musical notes, which are displayed on display 216 as an output string in the form of human readable musical notes (block 604).

Each recipe, or "version," begins as a unique substitution cipher that assigns a note, or empty space (e.g., a pause) to be later filled according the recipe algorithm, for each letter of the alphabet. In other embodiments, recipes may assign different character strings (e.g., words, punctuation, numbers, etc.) to a single note or pause. Example recipes, and corresponding ciphers, are provided in Table 1 below:

TABLE 1

| | Letter | | | | | | | | | | | | | | | | | | | | | | | | | |
|---|---|---|---|---|---|---|---|---|---|---|---|---|---|---|---|---|---|---|---|---|---|---|---|---|---|---|
| | a | b | c | d | e | f | g | h | i | j | k | l | m | n | o | p | q | r | s | t | u | v | w | x | y | z |
| Original Recipe | G | F | E | D | C | B | A | G | F | E | D | C | B | A | G | F | E | D | C | B | A | A | B | C | D | E |
| Mirrors | D | E | F | G | A | B | C | D | E | F | G | A | B | C | D | E | F | G | A | B | C | G | F | E | D | C |
| Ceasar | A | B | C | D | E | F | G | F | E | D | C | B | A | B | C | D | E | F | G | F | E | D | E | F | G | A |
| Zig-Zag | A | B | C | D | E | F | G | F | E | D | C | B | A | B | C | D | E | F | G | F | E | D | C | B | A | B |
| FM | C | F | F | C | A | B | D | A | E | C | A | D | G | F | D | E | D | B | G | B | E | G | A | B | C | E |
| IOU | A | B | C | D | B | C | D | E | C | D | E | F | G | A | D | E | F | G | A | B | E | F | G | A | F | G |
| 2 × 4 | E | F | | D | B | F | | D | E | | | | F | A | C | C | | F | B | A | G | | G | | B | |
| "10" | F | C | | F | B | G | | E | B | | | | G | F | C | E | | G | G | A | A | | D | | G | |

The outputted string can then be manipulated manually by the user throughout the levels of the program as will be described in detail below. It should be understood that the software program is not limited to the above described recipes. Additional recipes can be added and existing recipes can be taken removed from the program per user preference. Additional recipes can be downloaded to the software program of device 102, for example, from one or more databases 108 associated with one or more servers 106, from network device 220 via one or more communications channels 110, from user-created manually inputted algorithms, or from memory storage devices in communication with memory 208 of device 102.

Referring again to FIG. 6, device 102 receives a user selection of a desired recipe and an optional user input for certain recipes such as, for example, the "2×4" and "Big 10" recipes (block 606). The user can select the preferred recipe, for example, by clicking on a box or radial button next to the respective recipe on screen/touchscreen 216 using a mouse cursor or human touch, the click visually displayed using symbols such as an "X", circle or a check mark in the box. FIG. 11 illustrates the user selections of block 606.

Regarding the optional user input for recipes such as the "2×4" and "Big 10," device 102 can receive a user selection based on any number between 0 and 7. The empty letter spaces, discussed above, are then filled in with following note letter values. For example, for recipe '2×4,' 0=leave blank, 1="D", 2="C", 3="B", 5="E", 6="A" and 7="B". For version "Big 10," 0=leave blank, 1="E", 2="D", 3="C", 4="B", 5="A", 6="F" and 7="A". This option therefore provides an instant "push button" dramatic change in the outputted string and the corresponding output sound of the chosen recipe.

Figure 7:
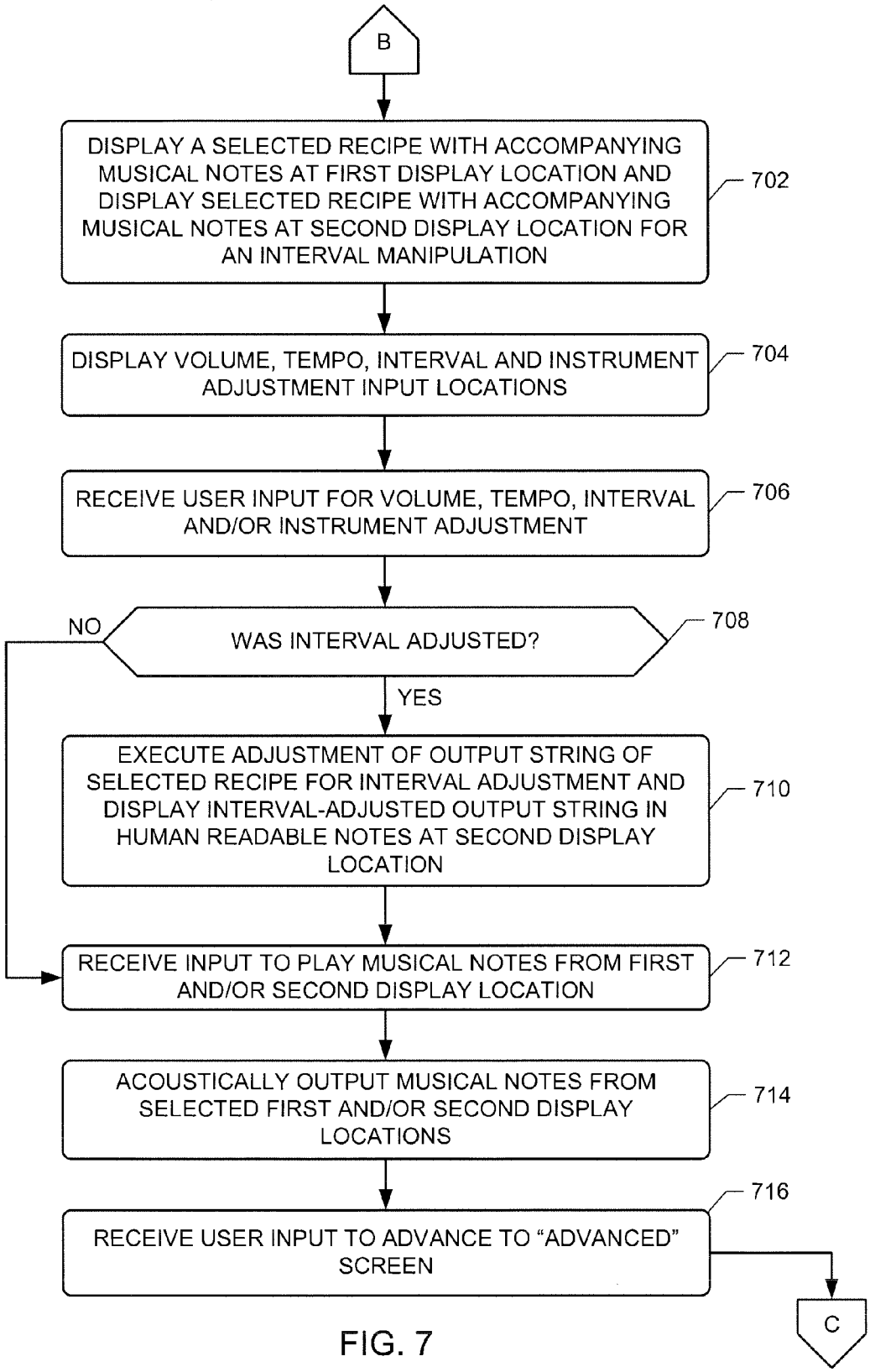
Figure 12:
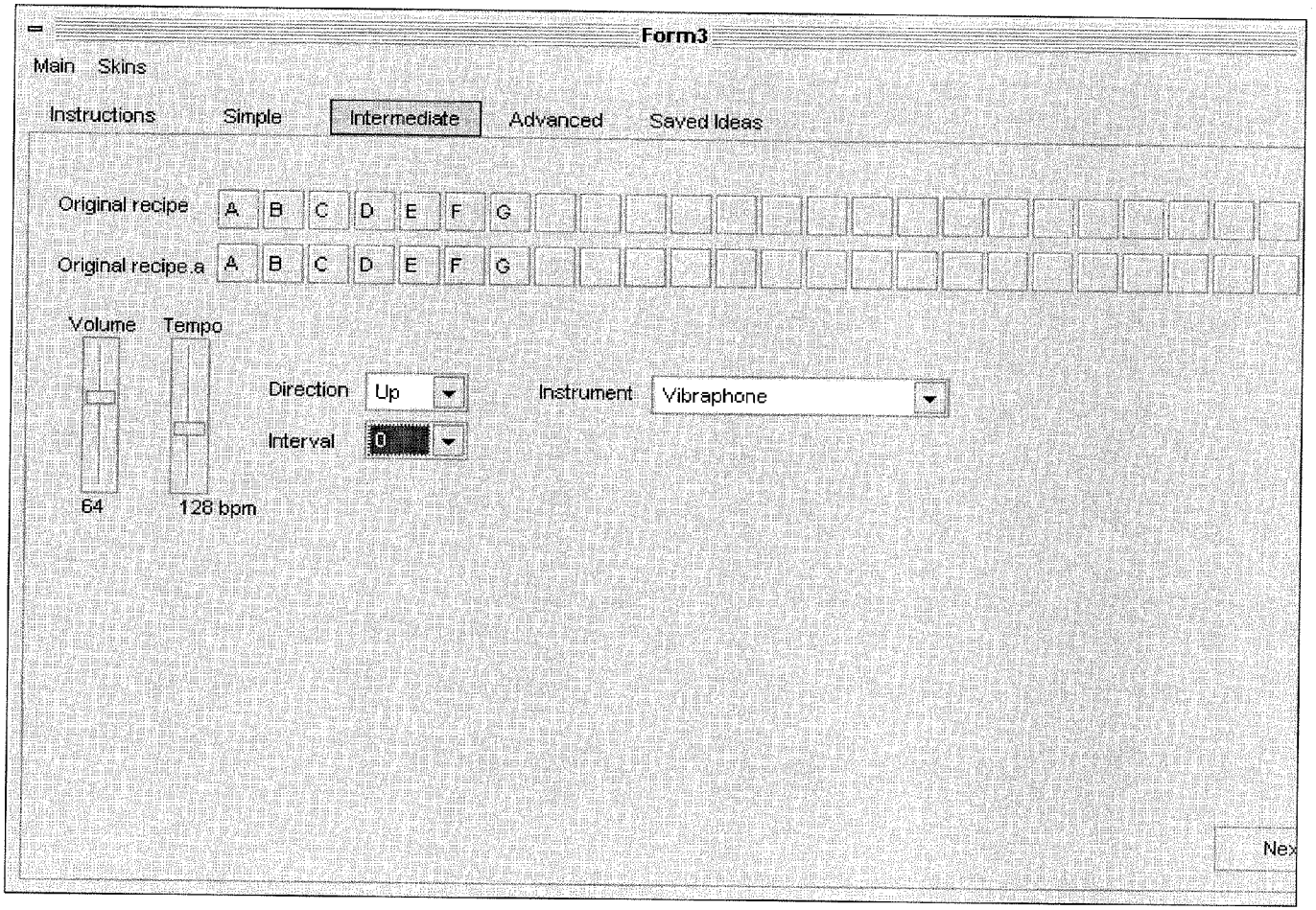
FIG. 12 shows a second user input page from an embodiment of the software program associated with FIG. 7 that creates music melodies.
Figure 13:
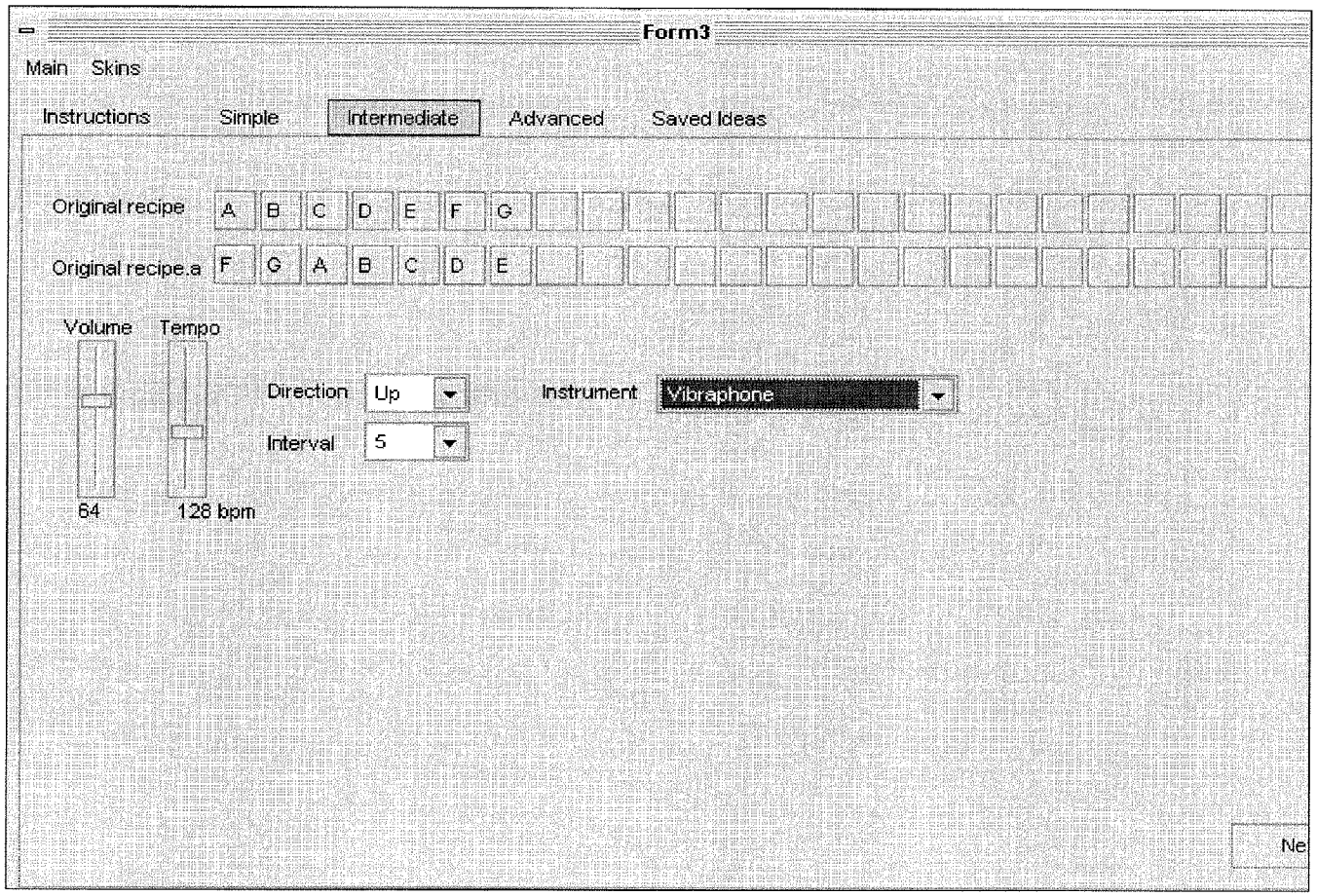
FIG. 13 shows the second user input page of FIG. 12 with an interval adjustment from an embodiment of the software program associated with FIG. 7 that creates music melodies.

Once the user enters a proper word and selects a desired recipe, device 102 receives the user input to advance to the "Intermediate" screen (block 608) illustrated by FIGS. 12 and 13 and described by the flowchart of FIG. 7. The user can advance to the "Intermediate" screen only after device 102 receives a user selection of a desired recipe. Referring to FIG. 11, the device can receive the necessary user input to advance to the "Intermediate" screen, for example, by either a mouse cursor or human touch of display screen/touchscreen at the "Next" button displayed on the display screen/touchscreen.

Referring to FIG. 7, screen/touchscreen 216 displays the selected recipe from the "Simple" screen along with the accompanying musical notes at a first display location. Screen/touchscreen 216 also displays the selected recipe with accompanying musical notes at a second display location for interval manipulation (block 702). The user interface displayed in FIGS. 12 and 13 labels the first display location as "Original recipe" and the second display location as "Original recipe.a." Screen/touchscreen 216 further displays volume, tempo, interval and instrument adjustment input locations (block 704) and receives user input for volume, tempo, interval and instrument adjustment input locations (block 706).

FIGS. 12 and 13 illustrate the volume and tempo adjustment input locations as scroll or drag bars for which the user can, using a mouse cursor or human touch, drag the bars upward to increase volume and/or tempo respectively, or drag the bars downward to decrease volume and/or tempo respectively. FIGS. 12 and 13 illustrate the interval adjustment input location as a combination of a first drop-down box for selecting the direction the interval will travel, and a second drop-down box for selecting the number of intervals to travel. Finally, FIGS. 12 and 13 illustrate the playback instrument adjustment input location as a drop-down box for selecting from a plurality of playback instruments. The available instruments for selection can vary dependent on factors such as, for example, user predefined preferences, an instrument list provided by the program, software updates, and computer soundcard limitations. Any acoustic output after this selection will be played in the sound of the selected instrument. Instruments include, for example, acoustic, bright or electric grand piano; honky-tonk, Rhodes or chorused piano; harpsichord; clarinet; celesta; glockenspiel; music box; vibraphone; marimba; xylophone; tubular bells; dulcimer; Hammond, percussive, rock, church or reed organ; accordion; harmonica; tango accordion; nylon acoustic, steel acoustic, jazz electric, clean electric, muted electric, overdriven or distortion guitar, etc.

Returning to FIG. 7, the software program of device 102 executes a routine to determine if interval has been adjusted (block 708). If the interval has not been adjusted, the routine ends. If the interval has been adjusted, the software program executes an adjustment of the output string of the selected recipe for interval adjustment and displays an interval-adjusted output string in human readable notes at a second display location (block 710). Referring to FIG. 13, for example, if the interval is adjusted "Up" by "5" intervals, the output string at the second display location "Original recipe.a" is adjusted accordingly and a new output string is displayed at the second display location. Individual notes and/or the entire outputted string can be moved up or down by any interval 0 to 7. In musical terminology, a shift of '0' is called a "unison," or a "first" interval. Thus a shift of '1' is a "second," a shift of '2' is a "third" and so on.

Device 102 receives user input to play musical notes from the first and/or second display locations (block 712) and acoustically outputs the selected musical notes according to adjustments to volume, tempo, interval and instrument (block 714). Referring again to FIGS. 12 and 13, the device can receive the necessary user input to play the musical notes, for example, by a mouse cursor or human touch of display screen/touchscreen at the "Play" buttons displayed next to each of the corresponding first and second display locations.

Device 102 receives user input to advance to the "Advanced" screen (block 716). At any time while on the "Intermediate" screen, the user can advance to the "Advanced" screen. Referring to FIGS. 12 and 13, the device can receive the necessary user input to advance to the "Advanced" screen illustrated by FIGS. 14 and 15 and described by the flowchart of FIG. 8, for example, by either a mouse cursor or human touch of display screen/touchscreen at the "Next" button displayed on the display screen/touchscreen.

Figure 8:
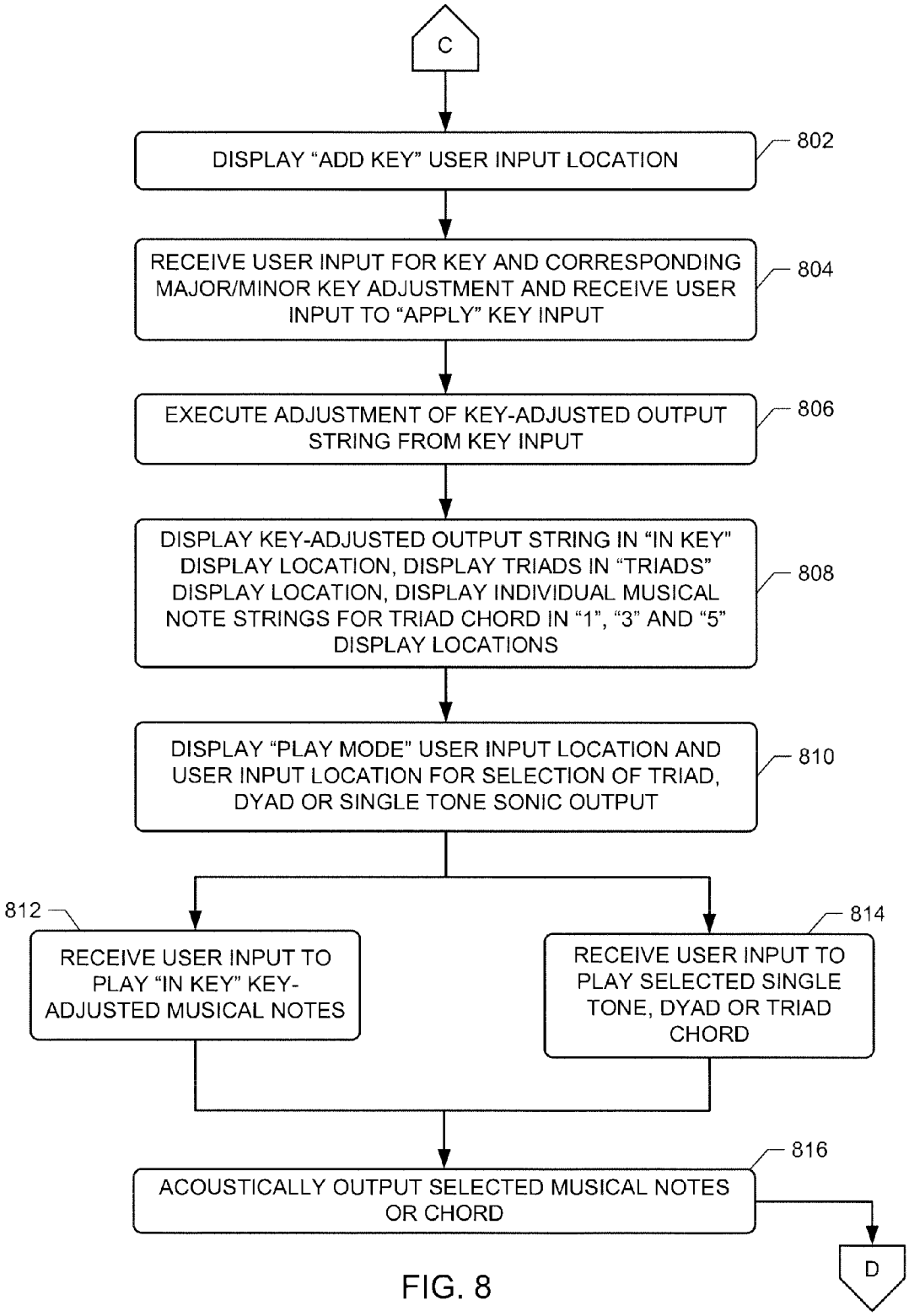
Figure 14:
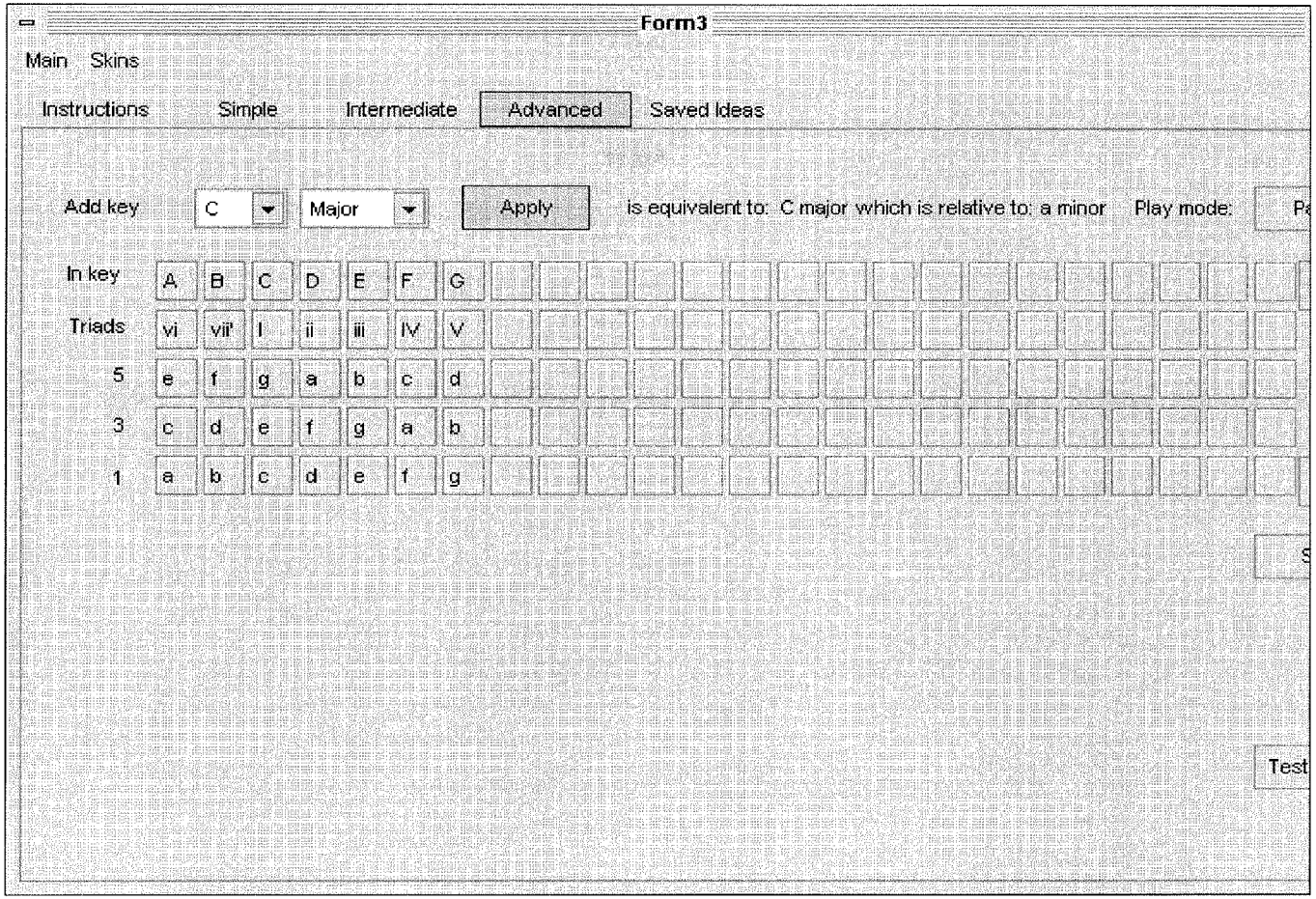
FIG. 14 shows a third user input page, with a major key adjustment, from an embodiment of the software program associated with FIG. 8 that creates music melodies.
Figure 15:
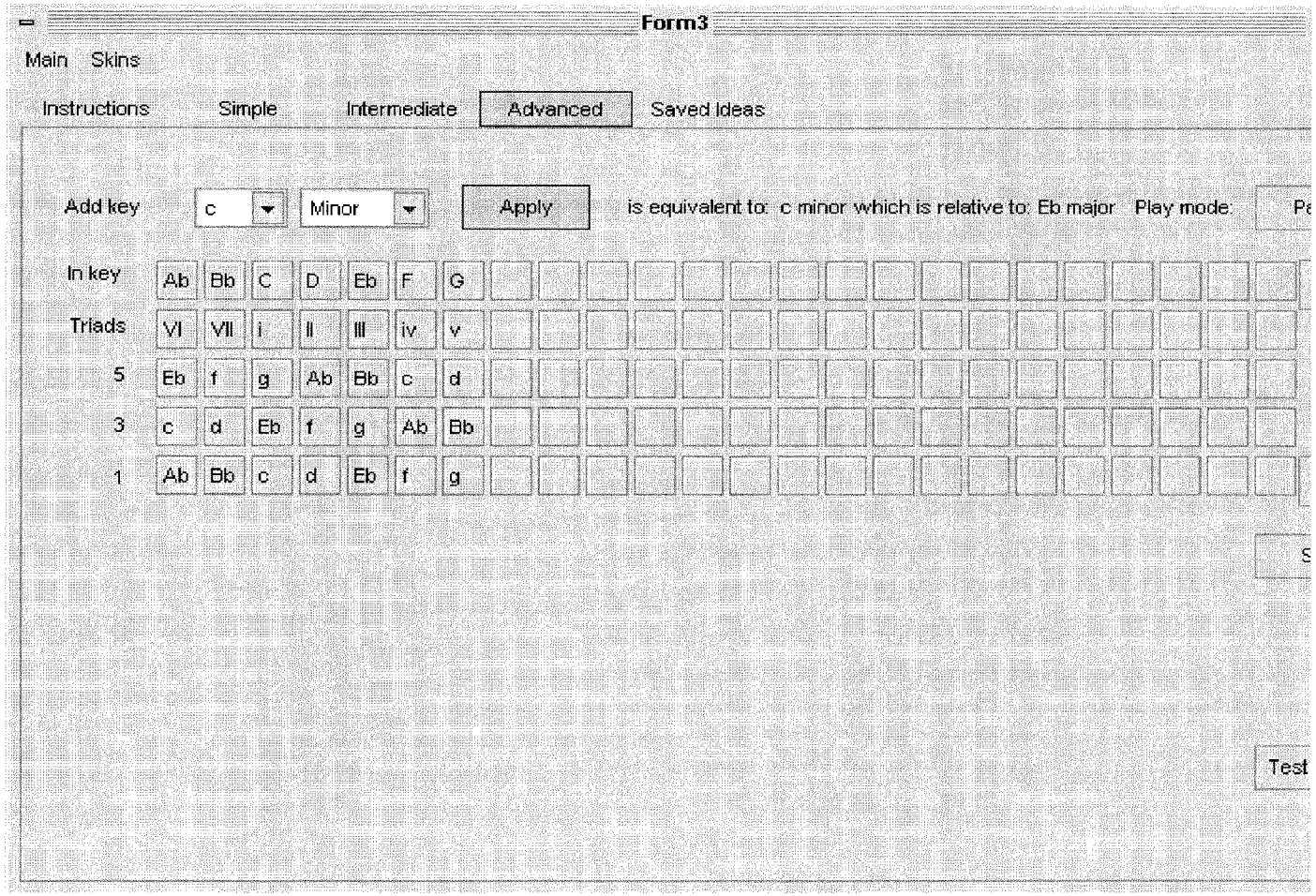
FIG. 15 shows the third user input page of FIG. 14, with the minor key adjustment, from an embodiment of the software program associated with FIG. 8 that creates music melodies.

Referring to FIG. 8, screen/touchscreen 216 of device 102 displays an "Add key" user input location (block 802). Device 102 receives user input for selecting a key and selecting a corresponding major/minor key adjustment. The device 102 also receives a user input to "apply" the key input (block 804). FIGS. 14 and 15 illustrate the "Add key" input location, which includes a first drop-down box for selection of a key (e.g., A, A#, Ab, B, B#, Bb, etc.) and a second drop-down box for selection of a key adjustment (i.e., major or minor). The device 102 receives a user input to execute the "Add key" selections, for example, by a mouse cursor or human touch of display screen/touchscreen at the "Apply" button displayed next to "Add key" input location.

The software program of device 102 executes the key selection (block 806) and displays a key-adjusted output string, triads based from the selected key, and three individual musical note strings for the triad chord (block 808). Referring to FIGS. 14 and 15, the illustrated display screen displays the key-adjusted output string in a display location labeled "In Key", displays the triads in a display location labeled "Triads", and displays the three individual musical note strings for the triad chord in display locations labeled "1", "3" and "5." The user can select to play back only the "In key" string.

Referring again to FIG. 8, screen/touchscreen 216 of device 102 displays a "play mode" user input location and a user input location for selection of one of a triad, dyad or single tone for an acoustic output (block 810). FIGS. 14 and 15 show that the "play mode" user input location includes two "Play" buttons with a first play button associated with the "In key" display location and a second play button associated with the "Triads" display location. The user can select triad, dyad or single tone, for example, by selecting a box or radial button next to the respective "3" and "5" display locations on the screen/touchscreen using a mouse cursor or human touch. The click may be visually displayed using symbols such as an "X", circle or a check mark in the box. The "3" corresponds to thirds (dyads), which are two note chords including a root and a third. The "5" corresponds to fifths (also dyads), which includes a root and fifth. The "Triads" are diatonic triads, which are three note chords usually including a root-third-fifth. FIGS. 14 and 15 illustrate the user selections of block 810.

Figure 23:
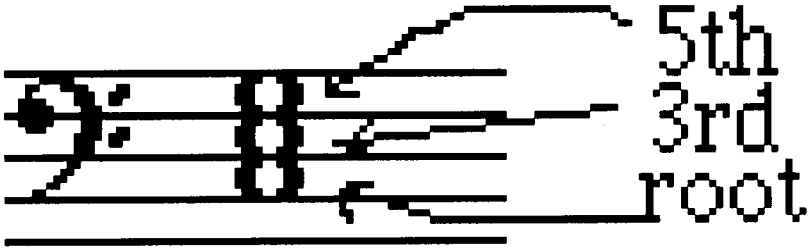
FIG. 23 shows a diagram of a portion of sheet music for a "parallel" play mode.

The "play mode" user selection can also include a mode selection that includes, for example, a "parallel" play mode and a "voice led" play mode. FIGS. 14 and 15 illustrate the mode selection with a "parallel" button, that when clicked, toggles between "parallel" and "voice led" play modes. "Parallel" play mode indicates that chords will be played back in "root" position, also called "first position," with the root on bottom, the third in the middle and the fifth on top, as illustrated by the portion of sheet music shown in FIG. 23.

Figure 17:
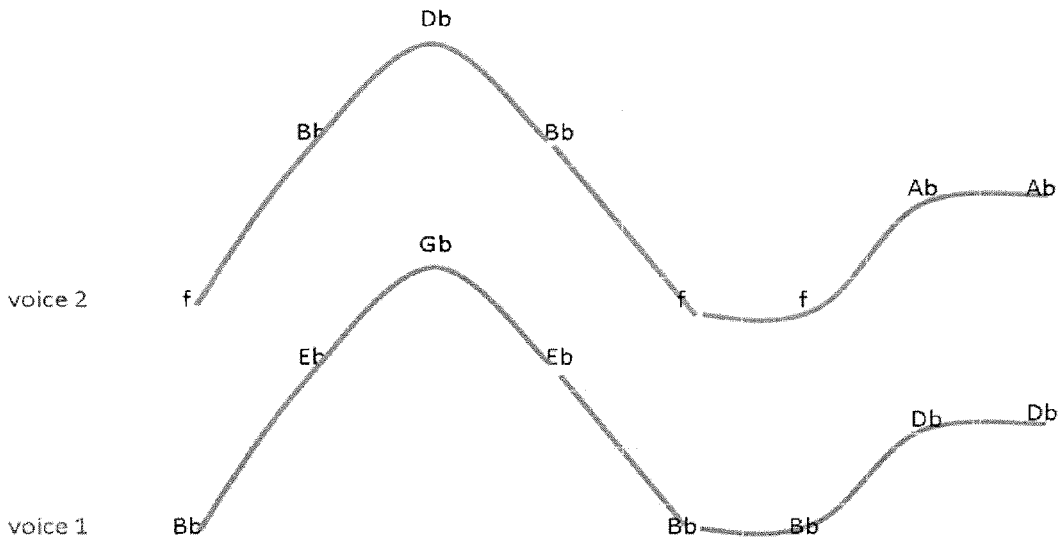
FIGS. 17 and 18 show graphs of acoustic waves for a "parallel mode" and a "voice led" mode of playback of two-note cords created by the example process described in conjunction with of FIGS. 5 to 9.
Figure 18:
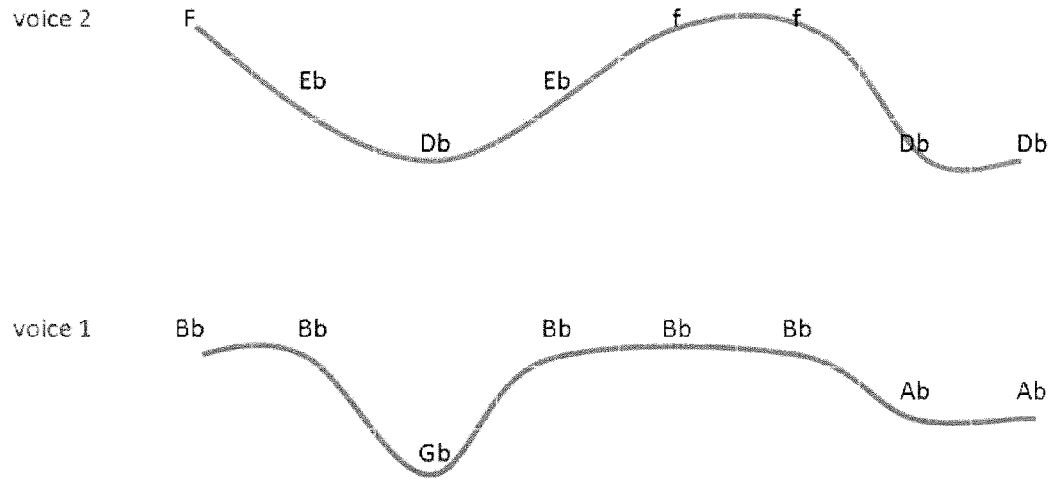

When choosing "parallel mode" the playback of the output string described above would graphically resemble the chart shown in FIG. 17. The "voice led" play mode is generally used for proper arrangement of multiple vocal, orchestral section or keyboard lines. However, it can be useful in any kind of composition to hear chords played back using inversions. Choosing "voice led" mode of the same example would graphically resemble the chart shown in FIG. 18.

The two-note chords represented in both graphs are identical. However, chords are rarely performed in parallel fashion, so listening in "voice led" mode sounds much more realistic. Therefore, if a user cannot quite hear the chord during acoustic output, a switch to the "parallel mode" can identify the root, third and fifth cords more easily. The "voice led" mode approximates the rules for music arranging by choosing the nearest note in each consecutive chord for the same voice. In the two example charts of FIGS. 17 and 18, the root ("voice 1") and fifth ("voice 2") of each chord are shown as being played.

Device 102 receives input to play the "In Key" key-adjusted output string (block 812) and/or the selected single tone, dyad or triad chord (block 814). The device 102 then acoustically outputs the selected musical notes or chord (block 816). Referring again to FIGS. 14 and 15, the device 102 can receive the necessary user input to play the musical notes, for example, by a mouse cursor or human touch of display screen/touchscreen at the "Play" buttons displayed next to each of the corresponding the "In key" and "Triads" display locations.

Note that FIGS. 14 and 15 show two different examples of key selections, with FIG. 14 illustrating a C-Major key and FIG. 15 illustrating a c-minor key. The choice of key affects the "In Key" output string, as well as the Triads output string and the three individual musical note strings for the triad chord in display locations labeled "1", "3" and "5".

While the present disclosure does not attempt to explain music theory, the following is a short illustrative explanation of Key. The keys of C-Major and C-minor do not use the same notes. This is illustrated by the concept of "relative key." The "relative minor key" of any Major key is made up the same notes used in that Major key scale. The relative minor begins on the 6th degree ('vi') of its relative Major scale. For example, the relative minor of C-Major is A-minor:

| | | | | | | | | | | | | | |
|---|---|---|---|---|---|---|---|---|---|---|---|---|---|
| C Major: | C | d | e | F | G | a | b | | | | | | |
| | I | ii | iii | IV | V | vi | vii' | | | | | | |
| A minor: | | | | | | a | b | C | d | e | F | G | |
| | | | | | | | i | ii' | III | iv | v | VI | VII |

Following the same process, the relative Major of C-minor would be Eb-Major:

| | | | | | | | | | | | | | |
|---|---|---|---|---|---|---|---|---|---|---|---|---|---|
| Eb Major: | Eb | f | g | Ab | Bb | c | d | | | | | | |
| | I | ii | iii | IV | V | vi | vii' | | | | | | |
| C minor | | | | | | c | d | Eb | f | g | Ab | Bb | |
| | | | | | | | i | ii | III | iv | v | VI | VII |

Figure 19:
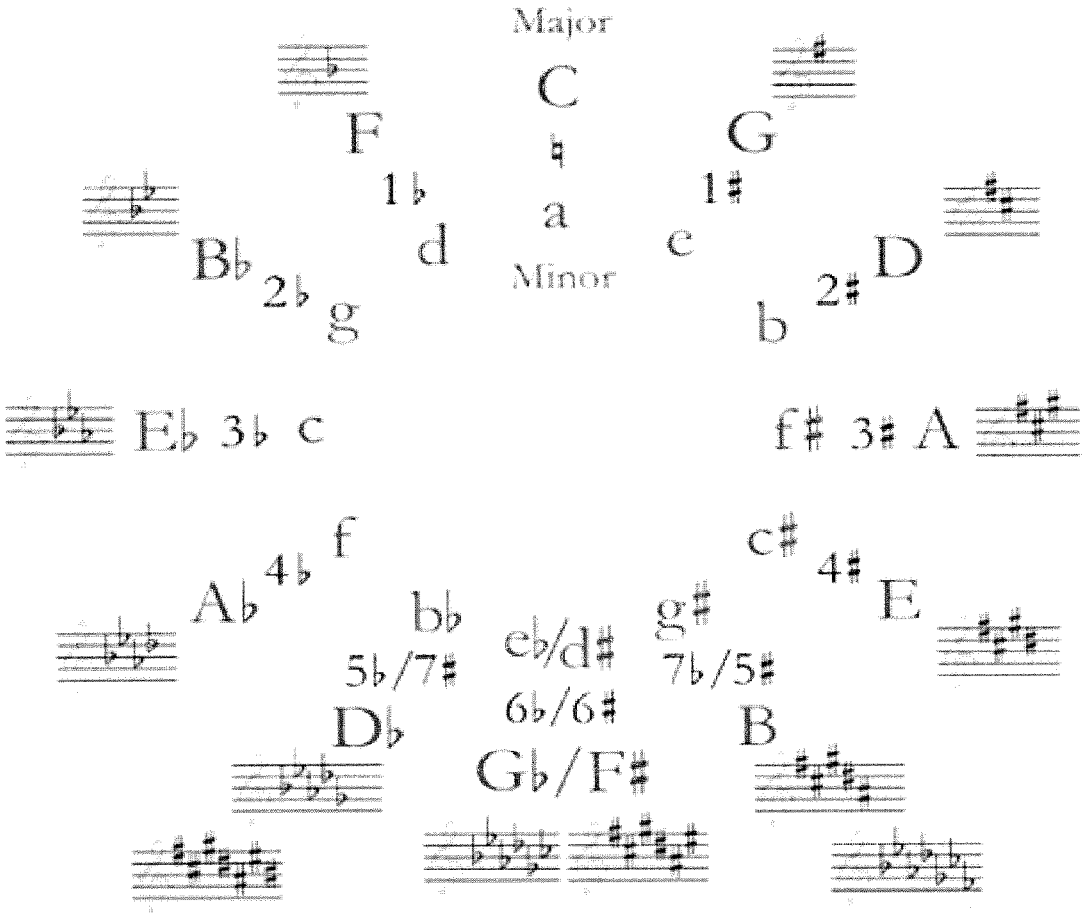
FIG. 19 shows a diagram of relationships between musical chords that may be used by the example process described in conjunction with of FIGS. 5 to 9.

The entire set of key-relationships is shown in FIG. 19. In musical terms, by selecting the C-Major key for a given output string, only the notes of the C-Major scale are used. Those notes are C, D, E, F, G, A and B. If the first three notes of the output are A, B and C, then the corresponding chords would consist of the root, third and fifth for each. In this case, A, C and E are the root, third and fifth of the "A" chord, B, D and F make up the "B" chord and C, E and G make up the "C" chord.

Additionally, the chords of a Major Key are denoted by roman numerals. Specifically, upper case letters denote major chords and lower case letters denote minor chords. The pattern of chords for a Major key is: I, ii, iii, IV, V, vi, vii'. Hence, C Major consists of the following chords: C-Major (I), d-minor (ii), e-minor (iii), F-Major (IV), G-Major (V), a-minor (vi) and b-diminished (vii') (which may be thought of for this explanation as a "doubly minor" chord). Thus, the example above consists of A-minor, B-diminished and C-Major chords.

By contrast, selecting a C-minor key for that same output string only uses the notes of the C-minor scale, which are C, D, Eb, F, G, Ab and Bb. The pattern for chords in a minor key is: i, ii', III, iv, v, VI, VII. Hence, C-minor consists of the following chords: c-minor (i), d-diminished (ii'), Eb-Major (III), f-minor (iv), g-minor (v), Ab-Major (VI) and Bb-Major (VII). The resultant chords for the example are: Ab-Major, Bb-Major and C-minor.

The Example provided below provides one example of a user-inputted word and the musical output of that string using an algorithm of the present disclosure.

EXAMPLE i) In "Simple" screen:
  (1) User enters the word "blue bird"
  (2) User chooses the "Caeser" recipe
  (3) The resulting output string is: "E-A-C-A E-E-G-G"
ii) In the "Intermediate" screen:
  (1) User sets volume
  (2) User sets tempo
  (3) User chooses "Rhodes Piano" as the playback instrument
  (4) User shifts the Direction "Down" by an Interval of "3"
  (5) The resultant notes played back are now "B-E-G-B B-B-D-D" using the
  "Rhodes Piano" as the playback instrument
iii) In "Advanced" screen:
  (1) User selects key of "Bb" (B flat) and "Major"
  (2) The resultant output is now "Bb-Eb-G-Eb Bb-Bb-D-D"
  (3) User chooses "fifths" from the "Triads" display location
  (4) The resulting output plays back the line in dyad chords:

| | | | | | | | | |
|---|---|---|---|---|---|---|---|---|
| Fifth: | F | Bb | Db | Bb | F | F | Ab | Ab |
| Root: | Bb | Eb | G | Eb | Bb | Bb | D | D |

Figure 9:
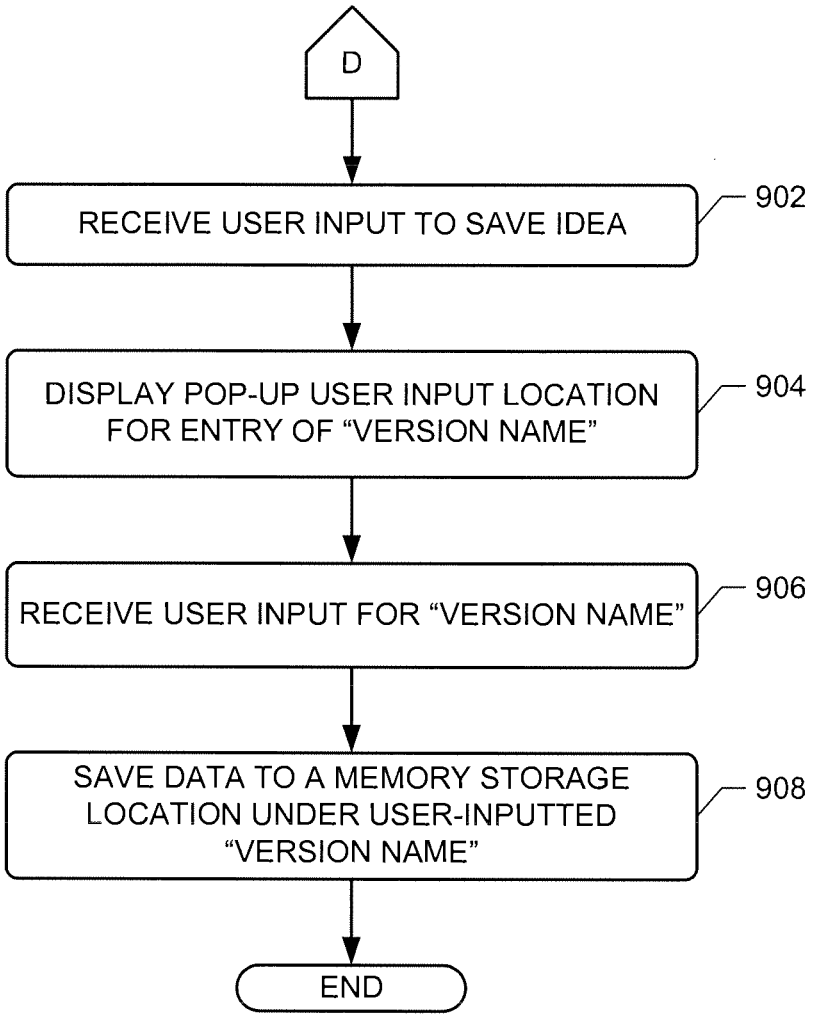
Figure 10:
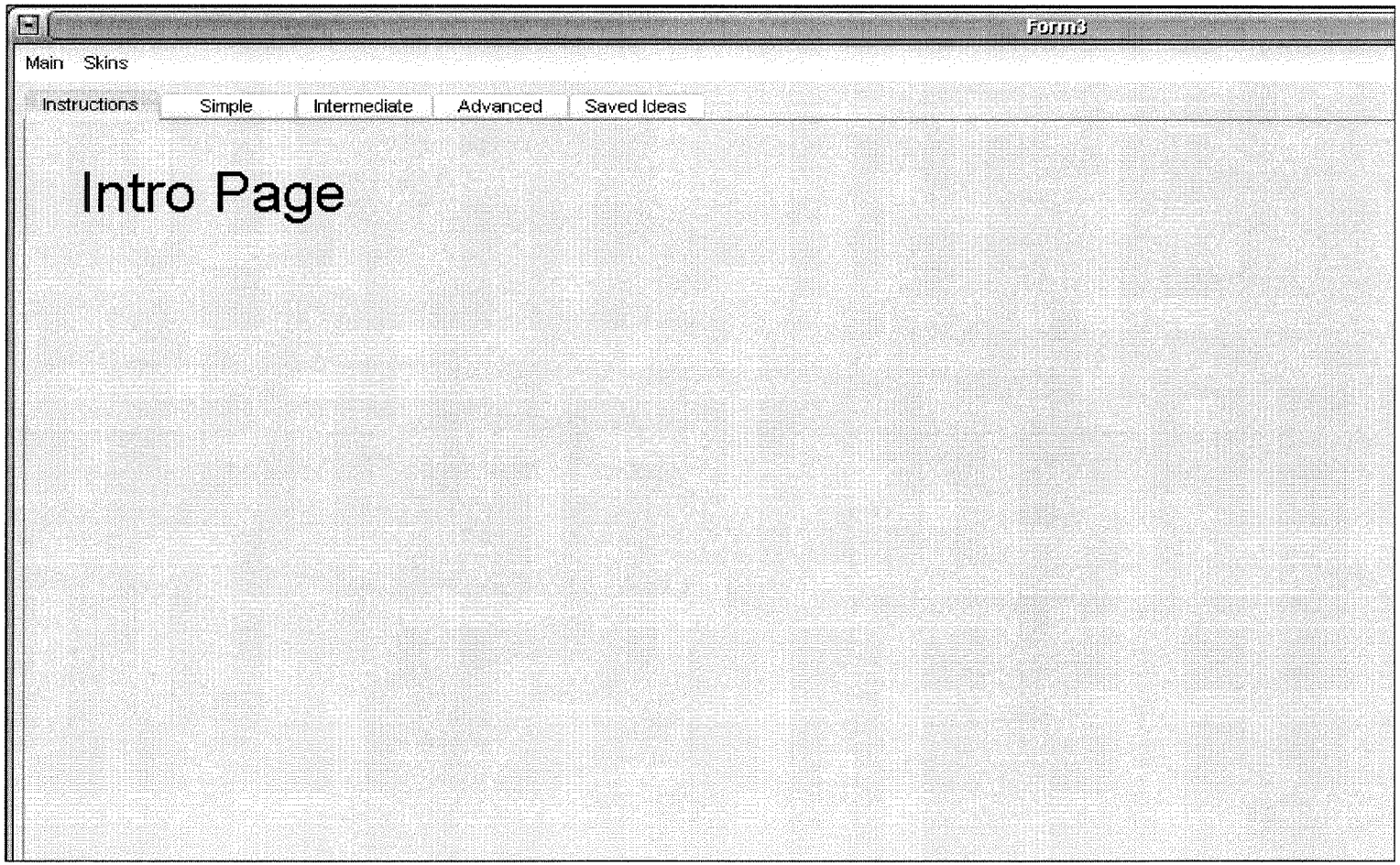
FIG. 10 shows an introductory page from an embodiment of the software program that creates music melodies.

Referring now to the flowchart of FIG. 9, device 102 receives a user input to save the melody, or "idea", created by the software program. Referring to FIGS. 14 and 15, the device can receive the necessary user input to save the idea, for example, by a mouse cursor or human touch of display screen/touchscreen at the "Save" button displayed on the screen/touchscreen.

Referring back to FIG. 9, the screen/touchscreen 216 displays a user input location for entry of a name of idea, or "version name" (block 902). The user input location can be, for example, in the form of a pop-up window with space to enter a name using input device 214, or program buttons 306, 404 (block 904). The device receives the user input for "version name" (block 906) and saves the entered name and corresponding idea in a memory storage location in memory 208 of device 102 (block 908).

Figure 16:
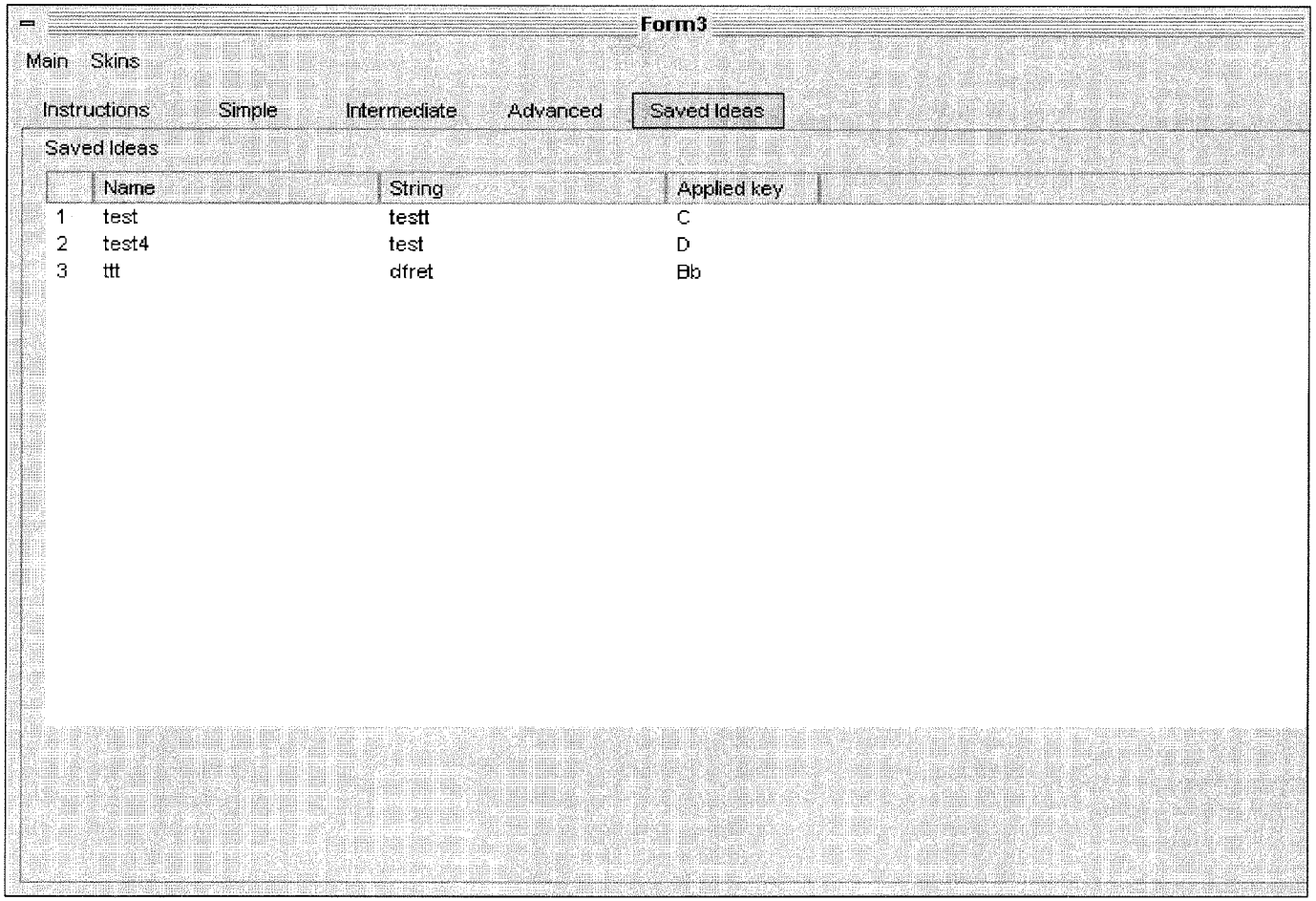
FIG. 16 shows a fourth user input page, for saving ideas and retrieving previously saved ideas, from an embodiment of the software program associated with FIG. 9 that creates music melodies.

FIG. 16 illustrates an example list of saved ideas, including each idea's name, the original character string inputted by the user at the "Simple" screen, and the applied key selected from the "Advanced" screen.

Mobile Application Embodiment

Figure 20:
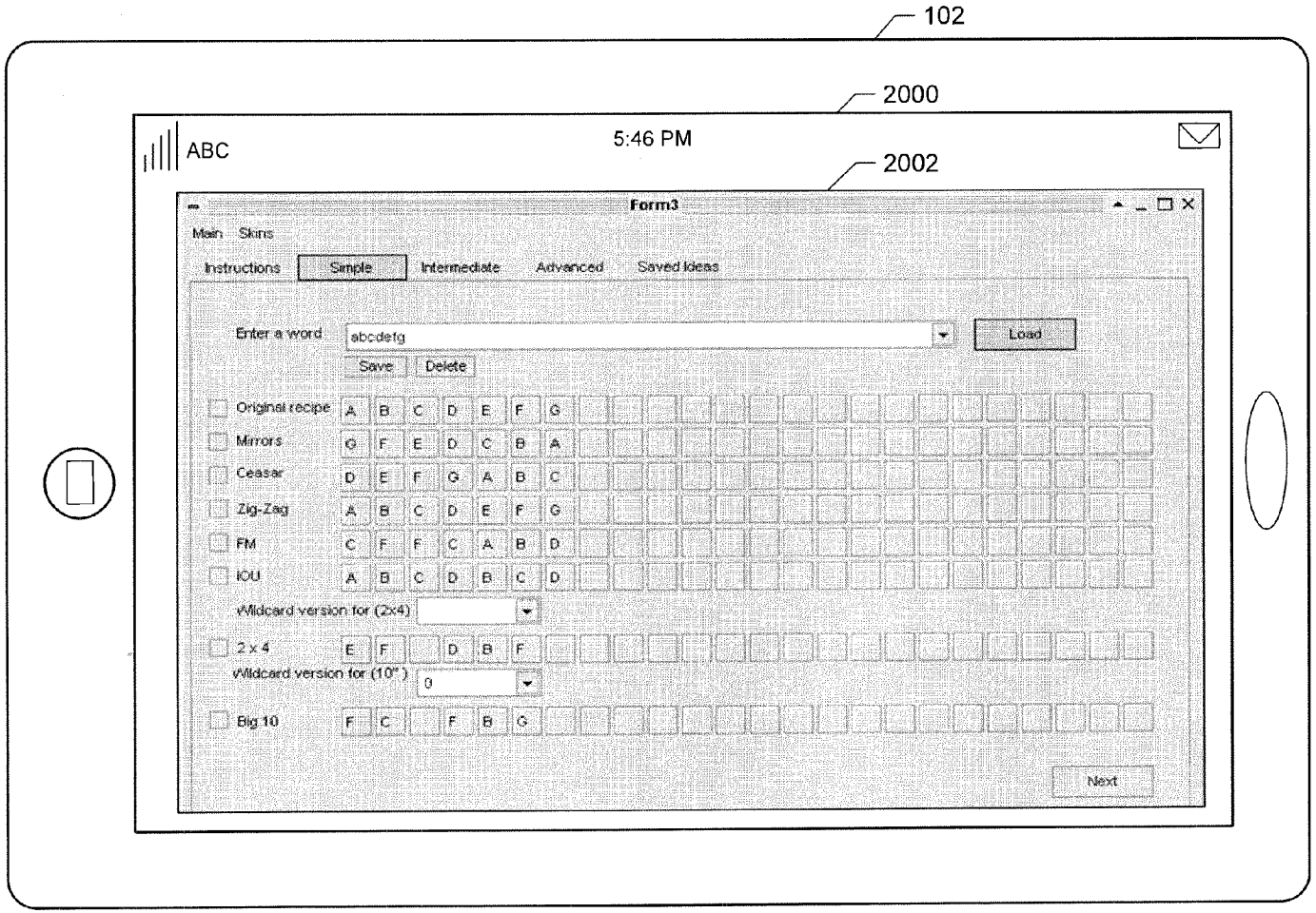
FIGS. 20 to 22 show example applications that may use the example process described in conjunction with of FIGS. 5 to 9.

FIG. 20 illustrates an example of device 102, which is in the form of a tablet computer or a smartphone (e.g., an Apple® iPad®, an Apple® iPhone®, a Samsung® Galaxy Tab™, a Motorola® Droid™, etc.) that includes a touchscreen 2000. The device 102 also includes a user interface 2002 that enables a user to interact with the software program to produce music melodies based on inputted characters. In this embodiment, the software program is a standalone application configured to operate on any mobile-based operating system including, for example, iOS®, Android®, Blackberry OS®, Windows Phone 7®, Nokia®, and WebOS®.

A user may download or otherwise install the software program described in conjunction with FIGS. 5 to 9 from an online store. In some instances, the mobile version of the software program may perform all of the features and functions described in conjunction with FIGS. 5 to 9 on the device 102. In other instances, the device 102 may connect to a remote server, which performs at least some of the features or functions.

For example, a user may use the user interface 2002 to enter a character string and select a recipe. The device 102 transmits the characters of the string and recipe to a remote central server. The central server applies the appropriate algorithms based on the selected recipe and transmits the resulting notes or chords to the device 102. The device 102 may then play the notes or chords as a melody.

Alternatively, the software program described in conjunction with FIGS. 5 to 9 is included within the application on the device 102. In this alternative instance, the processor of the device 102 converts characters or text into musical notes or chords using algorithms provided by the local software, which may be programmed with the process described in conjunction with FIGS. 5 to 9. A user may then use the connectivity capabilities of the device 102 to then transmit the newly created melodies.

Additionally, a user may create libraries of melodies stored locally on device 102 or remotely on a computer or server. A user may access these libraries to play one or more melodies. A user may also combine melodies from libraries to form new melodies.

Social Media Embodiment

Figure 21:
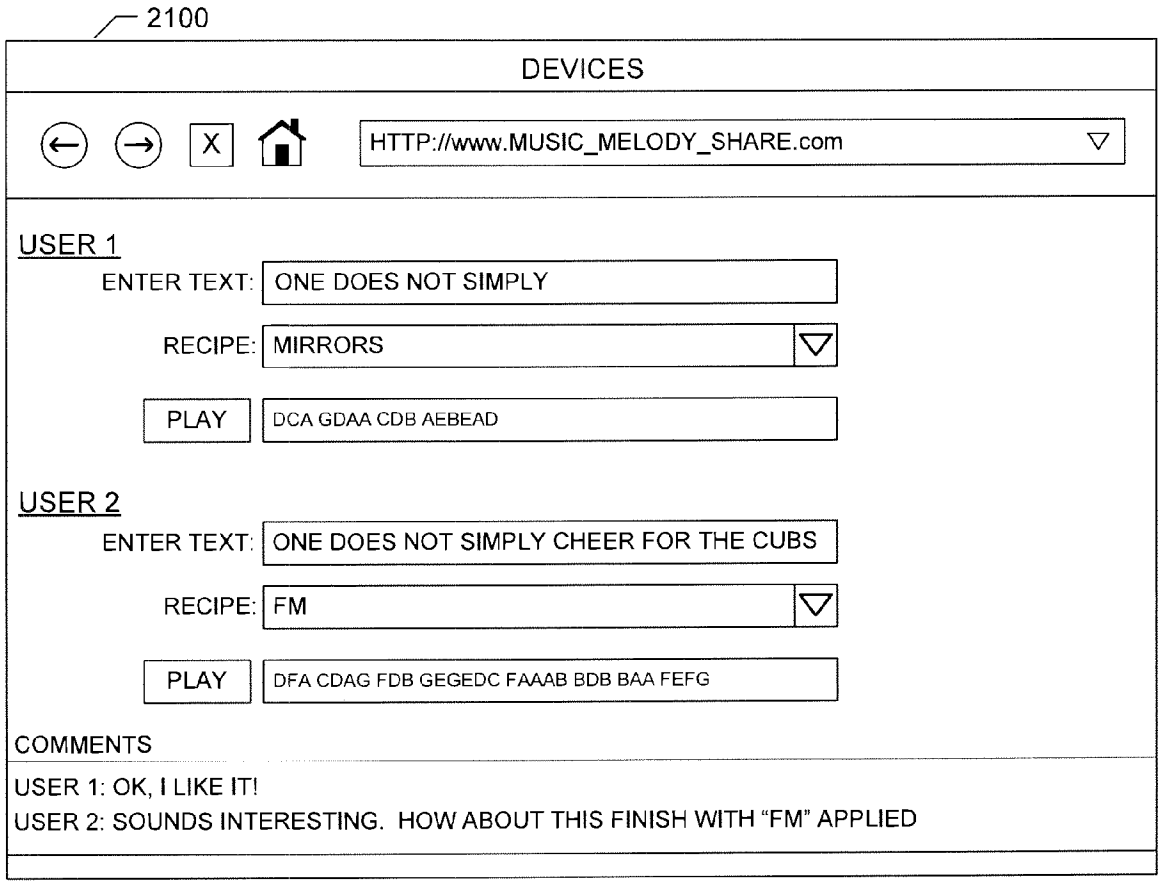

FIG. 21 shows the software program described in conjunction with FIGS. 5 to 9 implemented as a plug-in application for a web browser 2100. In this embodiment, the web browser 2100 enables users to jointly access the software program operating on a remote server (e.g., the server located at the web address 'www.MUSIC_MELODY_SHARE.com') to collaborate on a music project. In other embodiments, device 102 makes the software program accessible to remote users.

In the illustrated embodiment, the web browser 2100 includes a first section that enables users to enter text, select a recipe, view notes of a melody corresponding to the text, and play back the melody. Here, USER 1 entered, "ONE DOES NOT SIMPLY" text and selected the "MIRRORS" recipe. In response, the software program generated the "DCA GDAA CDB AEBEAD" notes. USER 2 then revised the text by adding, "CHEER FOR THE CUBS" and selected the "FM" recipe. In response, the software program generated the "DFA CDAG FDB GEGEDC FAAAB BDB BAA FEFG" notes. USER 2 also commented on USER 1's melody.

The web browser 2100 also includes a second section that enables users to provide comments and make suggestions to modify the newly created melody. The web browser 2100 may also include functions (volume, tempo, instrument, interval adjustment) that enable users to change the melody. In other examples, the web browser 2100 may enable additional users to view, listen, and edit the melody or enable a community of users to rate or rank the melody.

In other embodiments, the software program described in conjunction with FIGS. 5 to 9 may be implemented as a plug-in for social media applications. In these embodiments, a user could create a tune or melody and then post the tune or melody to a social media message board (such as Twitter® or Facebook®). For example, instead of responding to a comment with a textual message, a user could respond with a melody. In another example, a user could copy another user's message, use the software program to convert the message into a melody, and post the melody with an accompanying message (e.g., "Here is how your post sounds when I apply the "FM" recipe"). A user would be able to listen to the melody using any media player without having to have the software program installed. For instance, the melody could be posted in an mp3 format.

In another embodiment, a text messaging service may use the software program described in conjunction with FIGS. 5 to 9 to enable users to send musical messages in the same manner that a text or picture message is transmitted and received. For instance, a user could create a melody using the software program described in conjunction with FIGS. 5 to 9 on device 102. The user then selects one or more contacts to transmit the newly created melody. The text messaging service next transmits the notes or chords to devices 102 associated with the contacts, which then acoustically play the notes or chords. A receiving device plays the melody using any media player or function for playing sounds without having to have the software program. Additionally, in some of these embodiments, a user can transmit a melody with accompanying text.

Cryptology Embodiment

Figure 5:
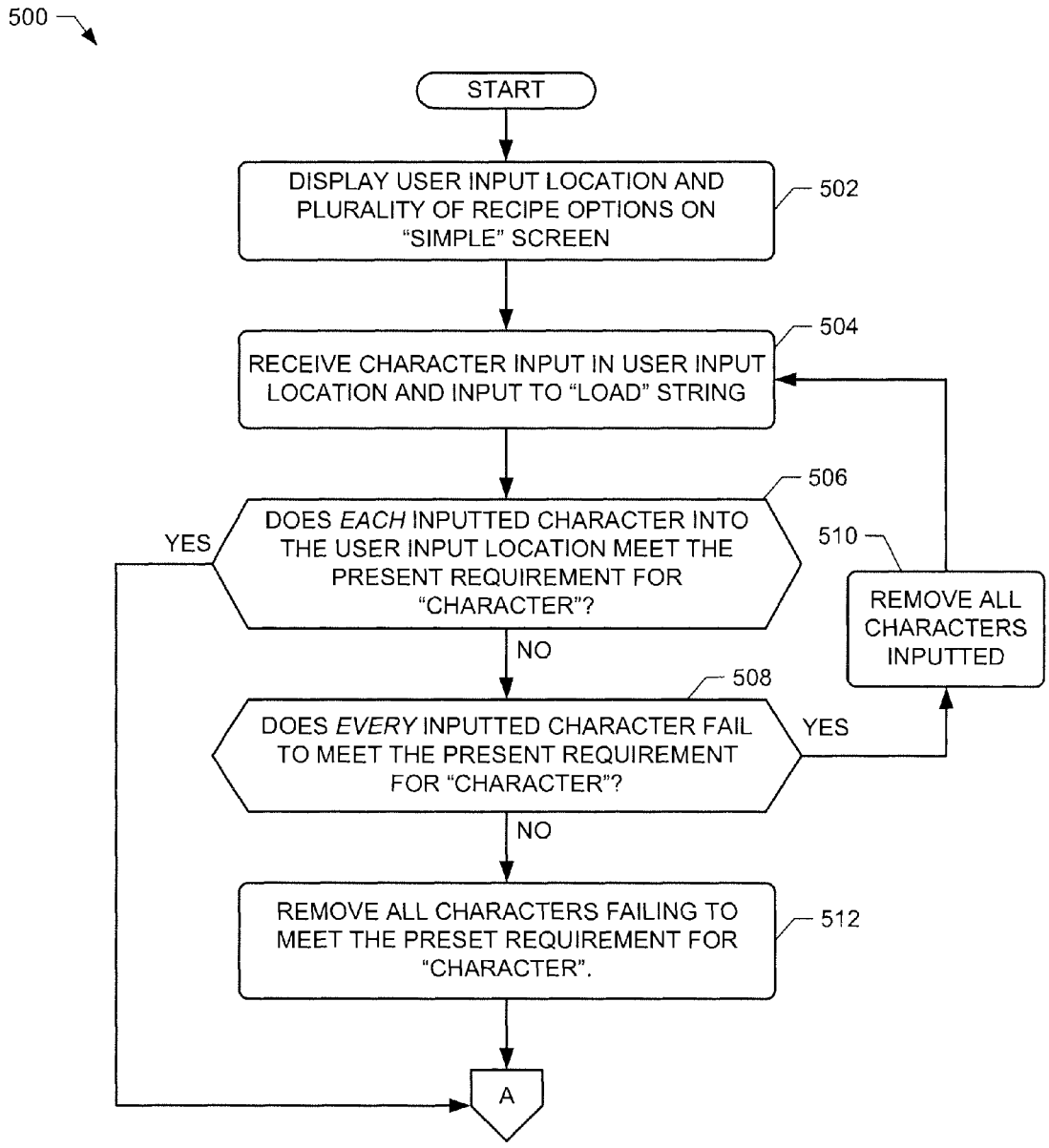
FIGS. 5 to 9 are a flowchart of an example process to create music melodies using an embodiment of the software program of the present invention.
Figure 22:
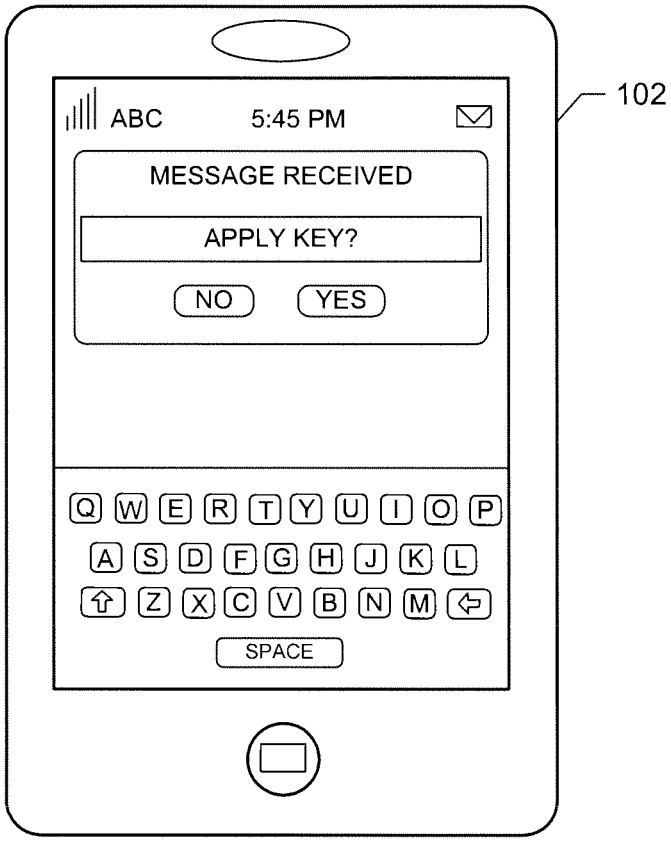

FIG. 22 illustrates device 102 operating with a software program described in conjunction with FIGS. 5 and 6. In this embodiment, the software program is used for encrypting and decrypting messages, data, or files. The software program could be used in conjunction with commercially available encryption applications or programs including, for example AES 128® or Blowfish®.

In the illustrated example, a user types a character or message of text on a device. The message may include punctuation, numbers, symbols, emoticons, etc. The user then instructs the device to encrypt the message using one of the recipes, thereby converting the message into notes or chords that comprise a melody. Alternatively, the device converts the message into letters representative of notes or chords. The device then transmits the notes or chords and the recipe type to device 102 displayed in FIG. 22. The transmission may be through any wired and/or wireless medium. The displayed device 102 receives the message, acoustically plays the encrypted message, and applies the algorithm(s) associated with the received recipe type to decrypt the message. The device 102 then displays the decrypted message.

In an example, a user types a message on a smartphone: "Meet me at the corner of Wacker and Adams at 7:00." The message may be typed into a text messaging application or an e-mail program. The user then selects to encrypt the message using the "Ceasar" recipe of the software program described in conjunction with FIGS. 5 and 6. The encrypted message would read: "AEEF AE AF FFE CCFBEF CF EACCEF ABD ADAAG AF ECC." The device transmits the string of chords and the indication that the "Ceasar" recipe was applied to the device 102, which then acoustically plays the chords as the encrypted message. The user may then instruct the device 102 to decrypt the message, thereby enabling the user to read the message.

The software program may also facilitate wireless acoustic transmission of encrypted data. This may be beneficial for transmitting musically encrypted data via sound waves in instances when wireless frequencies normally available for data transfer are not available or not desirable for use. For instance, the software program may be used when wireless transmission hardware (such as cell towers and routers) is unavailable or congested. In these instances, a microphone of device 102 may record the melody of the encrypted data. The device may also record the type of recipe being applied as an acoustical code. The software program converts recorded melody into a digital string of chords and references the acoustic code to the appropriate recipe type. The software program then uses the process described in conjunction with FIGS. 5 and 6 to decrypt the recorded melody.

In other instances, the software program described in conjunction with FIGS. 5 and 6 can be used to encrypt an entire file or data stream. In these instances, the file or data may not be played to a receiving user based on the amount of information encrypted. In some of these instances, the encrypted file or streamed data may be displayed as sheet music prior to being decrypted.

In summary, persons of ordinary skill in the art will readily appreciate that methods and apparatus for producing music melodies have been provided. The foregoing description has been presented for the purposes of illustration and description. It is not intended to be exhaustive or to limit the invention to the exemplary embodiments disclosed. Many modifications and variations are possible in light of the above teachings. It is intended that the scope of the invention be limited not by this detailed description of examples, but rather by the claims appended hereto.

What is claimed is:

1. A music creation apparatus comprising:

at least one input device;

at least one output device;

at least one processor; and at least one memory device which stores a plurality of instructions, which when executed by the at least one processor, cause the at least one processor to:

(a) receive an input of characters unrelated to musical notes through the at least one input device;

(b) receive a selection of a recipe through the at least one input device;

(c) determine whether each character is a valid character, wherein a valid character includes a number or a letter of an alphabet;

(d) remove each invalid character;

(e) transform the remaining characters into a string of musical notes by executing an algorithm corresponding to the recipe; and (f) output the string of musical notes in a human readable format through the at least one output device.

2. The music creation apparatus of claim 1, further comprising an audio output device communicatively coupled to the at least one processor, the audio output device to generate acoustic signals corresponding to the string of musical notes.

3. The music creation apparatus of claim 1, wherein the algorithm includes mathematical probabilities and at least one substitution ciphering function to associate different characters with different musical notes or pauses.

4. The music creation apparatus of claim 1, wherein the at least one processor is configured to enable the string of musical notes to be modified by adjusting a volume, tempo, interval, or instrument of one or more of the musical notes.

5. The music creation apparatus of claim 1, wherein the at least one processor is configured to enable the string of musical notes to be modified by adding or removing musical notes or applying major/minor musical note adjustments.

6. The music creation apparatus of claim 1, wherein the at least one processor is configured to:

receive an input from a remotely located computing device, the input modifying the string of musical notes; and output the string of modified musical notes in a human readable format through the at least one output device.

7. The music creation apparatus of claim 1, wherein the at least one processor is configured to transmit the string of musical notes to a remotely located server, the server to make the string of musical notes accessible to one or more computing devices.

8. The music creation apparatus of claim 1, wherein the human readable format includes sheet music.

9. A method of operating a music creation system comprising:

receiving, via a computing device, an input of characters and a recipe type, the characters being unrelated to musical notes;

determining whether each character is a valid character, wherein a valid character includes a number or a letter of an alphabet;

removing each invalid character;

transforming the remaining characters into a string of musical notes by executing an algorithm via the computing device, the algorithm corresponding to the recipe type;

displaying the string of musical notes in a human readable format via the computing device; and acoustically outputting the string of musical notes via the computing device.

10. The method of claim 9, further comprising:

determining whether there are any valid characters remaining; and requesting additional characters if there are no valid characters remaining.

11. The method of claim 9, wherein the algorithm includes at least one substitution ciphering function to associate different characters with different musical notes or pauses.

12. The method of claim 9, wherein the algorithm includes at least one substitution ciphering function to associate different words or groups of characters with different musical notes or pauses.

13. The method of claim 9, further comprising:

accessing a social media application via the computing device, the social media application operating on a server that is remotely located from the computing device;

transmitting the string of musical notes to the social media application; and sending a request to the social media application causing the social media application to make the string of musical notes available to other computing devices, wherein the social media application enables the string of musical notes to be acoustically output to the other computing devices.

14. The method of claim 13, wherein the request identifies which users of the other computing devices are authorized to access the string of musical notes.

15. The method of claim 9, further comprising transmitting the string of musical notes to a second computing device causing the second computing device to acoustically output the string of musical notes.

16. The method of claim 9, wherein the string of input characters is received from a second computing device.

17. The method of claim 16, further comprising transmitting the string of musical notes to the second computing device causing the second computing device to acoustically output the string of musical notes.

18. An encryption apparatus comprising:

at least one input device;

at least one output device;

at least one processor; and at least one memory device which stores a plurality of instructions, which when executed by the at least one processor, cause the at least one processor to (a) receive an input of characters through the at least one input device, the characters corresponding to a message, (b) receive a selection of a recipe through the at least one input device, (c) determine whether each character is a valid character, wherein a valid character includes a number or a letter of an alphabet;

(d) remove each invalid character;

(e) transform the remaining characters into a string of musical notes b executing an algorithm corresponding to the recipe, and (f) transmit the string of musical notes and a recipe type via the at least one output device to a communicatively coupled destination computing device.

19. The encryption apparatus of claim 18, wherein the destination computing device:

receives the string of musical notes and the recipe type;

executes a second algorithm corresponding to the recipe to transform the string of musical notes into characters; and displays the characters.

20. The encryption apparatus of claim 18, wherein the at least one processor transmits the string of musical notes to the destination computing device via a wireless communication medium.

21. The encryption apparatus of claim 18, wherein the at least one processor transmits the string of musical notes to the destination computing device via sound waves.

22. The music creation apparatus of claim 1, wherein the characters are at least one of letters, numbers, punctuation marks, symbols, words, phrases, and combinations thereof.

23. The encryption apparatus of claim 18, wherein the characters are at least one of letters, numbers, punctuation marks, symbols, words, phrases, and combinations thereof.

* * * * *